US007959267B2

(12) United States Patent
Tanaka et al.

(10) Patent No.: US 7,959,267 B2
(45) Date of Patent: Jun. 14, 2011

(54) LIQUID EJECTION APPARATUS

(75) Inventors: Ryoichi Tanaka, Shiojiri (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 855 days.

(21) Appl. No.: 11/946,488

(22) Filed: Nov. 28, 2007

(65) Prior Publication Data

US 2008/0122902 A1 May 29, 2008

(30) Foreign Application Priority Data

Nov. 29, 2006 (JP) ..... 2006-321765
Aug. 21, 2007 (JP) ..... 2007-215136

(51) Int. Cl.
*B41J 2/175* (2006.01)

(52) U.S. Cl. ..... 347/84; 347/85

(58) Field of Classification Search ..... 347/5, 7, 347/84, 85

See application file for complete search history.

(56) References Cited

U.S. PATENT DOCUMENTS 5,659,347 A * 8/1997 Taylor ..... 347/85
6,206,511 B1 * 3/2001 Cook et al. ..... 347/85
6,234,616 B1 5/2001 Komuro et al.
6,981,761 B2 * 1/2006 Usui et al. ..... 347/85
7,341,335 B2 * 3/2008 Akahane et al. ..... 347/85

FOREIGN PATENT DOCUMENTS

JP 357087370 * 5/1982 ..... 347/85
JP 09-262972 7/1997
JP 11-070668 A 3/1999
JP 2001-187458 7/2001
JP 2003-344643 12/2003
JP 2006-175626 7/2006

* cited by examiner

*Primary Examiner* — Anh T. N. Vo
(74) *Attorney, Agent, or Firm* — Sughrue Mion, PLLC

(57) ABSTRACT

A liquid ejection apparatus having a liquid ejection head and a switching device is provided. The switching device includes a first supply passage through which first liquid flows, a second supply passage through which second liquid different from the first liquid flows, a head supply passage, a first ON-OFF valve that selectively opens and closes the first supply passage, a second ON-OFF valve that selectively opens and closes the second supply passage, a rotary cam, and an actuator. The head supply passage extends from a joining point between a downstream end of the first supply passage and a downstream end of the second supply passage to the liquid ejection head. The actuator is driven by the cam in such a manner that the first ON-OFF valve and the second ON-OFF valve are selectively opened and closed. The actuator operates the first and second ON-OFF valves in such a manner that one of the first and second ON-OFF valves becomes open and the other becomes closed.

12 Claims, 11 Drawing Sheets

LIQUID EJECTION APPARATUS

CROSS-REFERENCE TO RELATED APPLICATION

This application is based upon and claims the benefit of priority from prior Japanese Patent Application Nos. 2006-321765 filed on Nov. 29, 2006, and 2007-215136 filed on Aug. 21, 2007, the entire contents of which are incorporated herein by reference.

BACKGROUND

1. Field of Technique

The present invention relates to a liquid ejection apparatus such as an inkjet type printer and a method for switching types of liquid supplied to a liquid ejection head of the liquid ejection apparatus.

2. Background Art

Typically, an inkjet type printer (hereinafter, referred to as a printer) is broadly known as a liquid ejection apparatus that ejects liquid onto a target. In the printer, ink is supplied from an ink cartridge, which retains ink, to a recording head (a liquid ejection head) that ejects the ink (the liquid). The recording head performs printing by ejecting the ink from a nozzle defined in a nozzle forming surface of the recording head onto a sheet of recording paper, or a target. In some of the printers, the ink cartridge is located at a position spaced from the recording head. In this case, the ink is supplied from the ink cartridge to the recording head through a tube routed in the printer.

To switch the ink ejected from the nozzle of the recording head to a different type of ink, supply of the ink from the currently used ink cartridge to the recording head is stopped. In this state, the ink is drained from the tube through the nozzle of the recording head. Subsequently, the different type of ink is supplied to the recording head from an ink cartridge that retains the ink through the tube.

However, such drainage of the ink from the tube, which is carried out when the ink to be ejected is switched from one type to another, increases wasteful consumption of the ink. To suppress such waste, Japanese Laid-Open Patent Publication No. 2006-175626 describes a printer in which a switching device connected to tubes extending from respective ink cartridges is arranged in the vicinity of the recording head.

In this printer, the type of the ink to be supplied to the recording head is switchable between a first type of ink (first liquid) and a second type of ink (second liquid) through the switching device. Specifically, in the switching device, a downstream end of a first passage (a first supply passage) that supplies the first type of ink and a downstream end of a second passage (a second supply passage) that supplies the second type of ink are joined into each other. A head supply passage that supplies the ink to the recording head is defined between the joining point and the recording head. Further, the switching device receives a first diaphragm (a first ON-OFF valve), a second diaphragm (a second ON-OFF valve), and a spring. The first diaphragm selectively opens and closes the first passage and the second diaphragm selectively opens and closes the second passage. The spring urges the first and second diaphragms to open. By closing one of the first and second diaphragms against the urging force of the spring and opening the other, the state of supply is switched between the first type of ink and the second type of ink.

To supply the first type of ink to the recording head, the switching device opens the first diaphragm of the first passage and closes the second diaphragm of the second passage. Contrastingly, to supply the second type of ink to the recording head, the second diaphragm of the second passage is opened and the first diaphragm of the first passage is closed.

The printer includes two sliders provided in the switching device. The sliders linearly move to swing corresponding pressing members, or a first pressing member (a first actuator) and a second pressing member (a second actuator). This selectively opens and closes the corresponding first and second diaphragms. This makes it necessary to create space for allowing movement of the two sliders in the switching device. As a result, the switching device becomes large-sized, enlarging the printer.

There is also a switching device without springs that urge first and second ON-OFF valves to open. In this case, if one of the first and second ON-OFF valves is maintained open with the other held in a closed state for a long time, the closed one of the ON-OFF valves may adhere to the valve seat and thus be prevented from opening even though the first ON-OFF valve and the second ON-OFF valve are both operated to open.

SUMMARY

Accordingly, it is a first objective of the present invention to reduce the size of a switching device that switches types of liquid supplied to a liquid ejection head. It is a second objective of the invention to reliably open an ON-OFF valve of the switching device even after the valve has been closed for a long time.

To achieve the foregoing objective and in accordance with a first aspect of the present invention, a liquid ejection apparatus including a liquid ejection head and a switching device is provided. The liquid ejection head ejects liquid. The switching device switches the type of liquid supplied to the liquid ejection head between a first liquid and a second liquid different from the first liquid. The switching device includes a first supply passage through which the first liquid flows, a second supply passage through which the second liquid flows, a head supply passage, a first ON-OFF valve, a second ON-OFF valve, a rotary cam, and an actuator. The head supply passage extends to the liquid ejection head from a joining point between a downstream end of the first supply passage and a downstream end of the second supply passage. The first ON-OFF valve selectively opens and closes the first supply passage at a position upstream from the joining point. The second ON-OFF valve selectively opens and closes the second supply passage at a position upstream from the joining point. When the cam rotates, the actuator is driven by the cam in such a manner that the first ON-OFF valve and the second ON-OFF valve are selectively opened and closed. The actuator operates the first and second ON-OFF valves in such a manner that one of the first and second ON-OFF valves becomes open and the other becomes closed.

In accordance with a second aspect of the present invention, a liquid ejection apparatus including a liquid ejection head that ejects liquid, and a switching device that switches the type of liquid supplied to the liquid ejection head between a first liquid and a second liquid different from the first liquid is provided. The switching device includes a first supply passage through which the first liquid flows, a second supply passage through which the second liquid flows, a head supply passage, a first ON-OFF valve, a second ON-OFF valve, an actuator, a transmission member, and a control section that controls the actuator. The head supply passage extends to the liquid ejection head from a joining point between a downstream end of the first supply passage and a downstream end of the second supply passage. The first ON-OFF valve selectively opens and closes the first supply passage at a position upstream from the joining point. The second ON-OFF valve selectively opens and closes the second supply passage at a position upstream from the joining point. The actuator selectively opens and closes the first ON-OFF valve and the second ON-OFF valve. The transmission member transmits a force applied to the first ON-OFF valve by the actuator to close the first ON-OFF valve to the second ON-OFF valve as a force that acts to open the second ON-OFF valve, and transmits a force applied to the second ON-OFF valve by the actuator to close the second ON-OFF valve to the first ON-OFF valve as a force that acts to open the first ON-OFF valve. To switch from a state in which one of the first and second ON-OFF valves is open and the other is closed to a state in which the first ON-OFF valve and the second ON-OFF valve are both open, the control section closes the open one of the first and second ON-OFF valves to open the closed one of the first and second ON-OFF valves, and then operates to permit the first and second ON-OFF valves to both open.

In accordance with a third aspect of the present invention, a method for switching the type of liquid supplied to a liquid ejection head of a liquid ejection apparatus between a first liquid and a second liquid different from the first liquid is provided. The method includes: providing a first supply passage through which the first liquid flows; providing a second supply passage through which the second liquid flows; providing a head supply passage extending to the liquid ejection head from a joining point between a downstream end of the first supply passage and a downstream end of the second supply passage; selectively opening and closing the first supply passage at a position upstream from the joining point using a first ON-OFF valve; selectively opening and closing the second supply passage at a position upstream from the joining point using a second ON-OFF valve; transmitting a force applied to the first ON-OFF valve to close the first ON-OFF valve to the second ON-OFF valve as a force that acts to open the second ON-OFF valve; transmitting a force applied to the second ON-OFF valve to close the second ON-OFF valve to the first ON-OFF valve as a force that acts to open the first ON-OFF valve; and closing, in switching from a state in which one of the first and second ON-OFF valves is open and the other is closed to a state in which the first ON-OFF valve and the second ON-OFF valve are both open, an open one of the first and second ON-OFF valves to open a closed one of the first and second ON-OFF valves and then permitting the first and second ON-OFF valves to both open.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

A first embodiment of the present invention will now be described with reference to FIGS. 1 to 11. The "front-and-rear direction", the "left-and-right direction", and the "up-and-down direction" herein correspond to the directions indicated by the corresponding arrows in the attached drawings.

Figure 1:
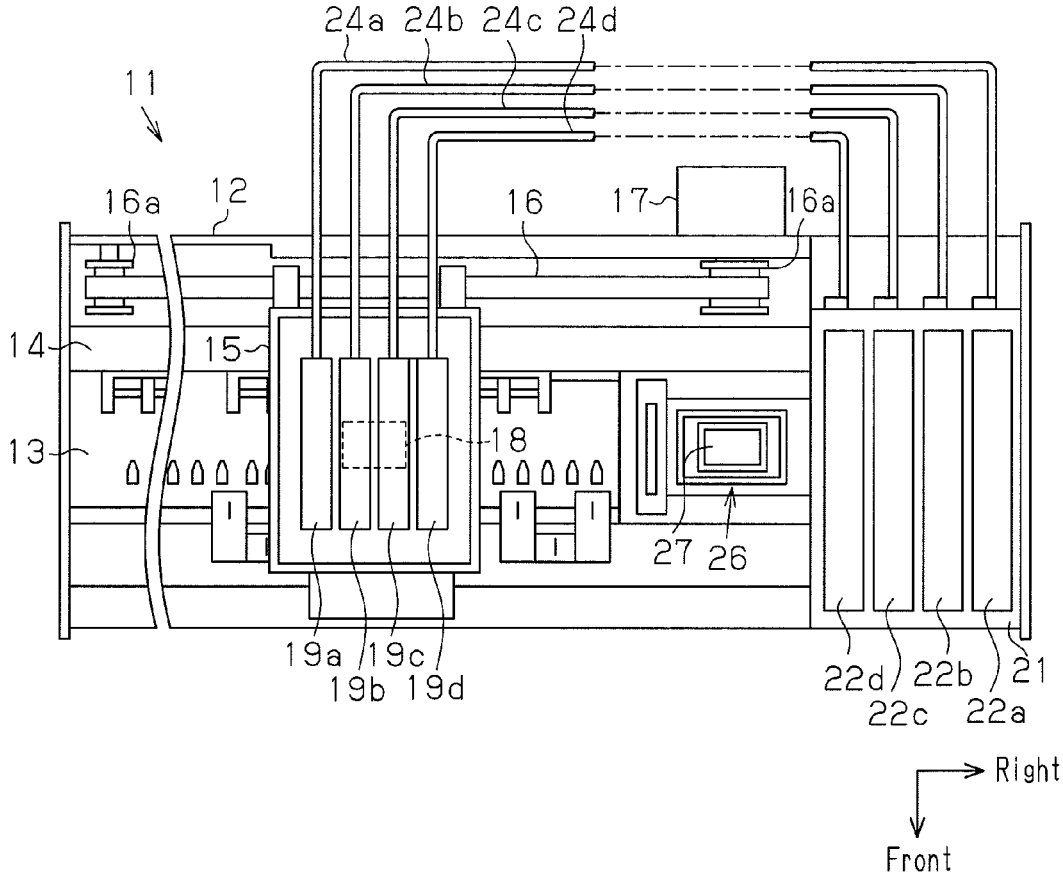
FIG. 1 is a plan view schematically showing an inkjet type printer according to a first embodiment of the present invention.

As shown in FIG. 1, an inkjet type printer 11, or a liquid ejection apparatus, includes a body frame 12 having a rectangular form as viewed from above. A platen 13, which extends in the left-and-right direction coinciding with the main scanning direction, is provided in the body frame 12. A non-illustrated paper feeder mechanism sends a sheet of recording paper, or a target, along the platen 13 and in the front-and-rear direction coinciding with the sub scanning direction. A bar-like guide shaft 14, which extends parallel with the longitudinal direction of the platen 13 at a position above the platen 13, is arranged in the body frame 12.

The guide shaft 14 supports a carriage 15 in such a manner as to allow the carriage 15 to reciprocate in the axial direction of the guide shaft 14. The carriage 15 is connected to a carriage motor 17 mounted in a rear wall of the body frame 12 through an endless timing belt 16, which is wound around a pair of pulleys 16*a* provided in an inner surface of the rear wall. The carriage 15 is driven by the carriage motor 17 to reciprocate along the axial direction of the guide shaft 14.

Figure 2:
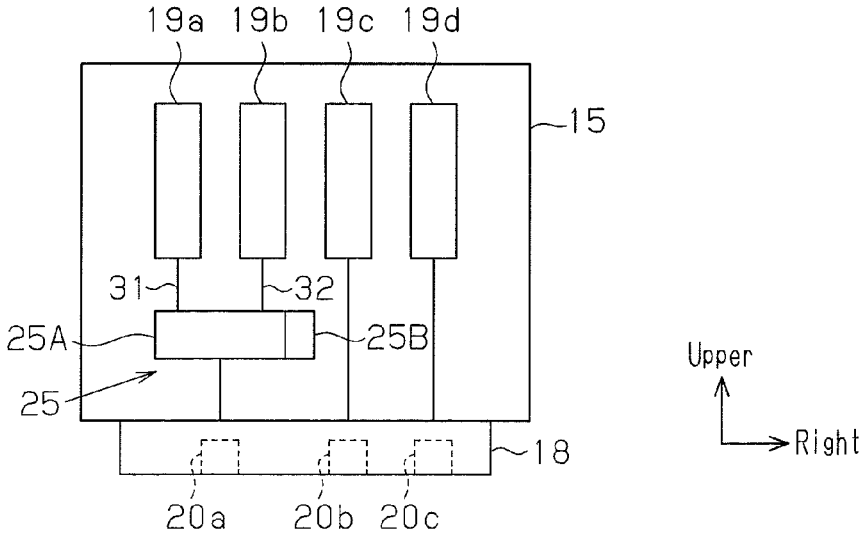
FIG. 2 is a front view schematically showing a carriage of the printer shown in FIG. 1.

With reference to FIGS. 1 and 2, a recording head 18, or a liquid ejection head, is formed in the surface of the carriage 15 opposed to the platen 13. The carriage 15 accommodates valve units 19*a*, 19*b*, 19*c*, 19*d*, which temporarily retain ink as liquid and supply the ink to the recording head 18. In the first embodiment, four valve units, which are first valve unit 19*a*, a second valve unit 19*b*, a third valve unit 19*c*, and a fourth valve unit 19*d*, are provided. A plurality of (in the first embodiment, three) nozzle rows 20*a*, 20*b*, 20*c* are defined in the lower surface of the recording head 18. Droplets of the ink are thus ejected from the nozzle rows 20*a* to 20*c* onto the recording paper sheet (not shown), which has been fed onto the platen 13, thus subjecting the recording paper sheet to printing.

A cartridge holder 21 is arranged at the right end in the body frame 12. Ink cartridges 22*a*, 22*b*, 22*c*, 22*d*, which retain different types of ink, are removably mounted in the cartridge holder 21. In the first embodiment, four ink cartridges, which are a first ink cartridge 22*a*, a second ink cartridge 22*b*, a third ink cartridge 22*c*, and a fourth ink cartridge 22*d*, are provided. Each of the ink cartridges 22*a* to 22*d* is connected to the corresponding one of the valve units 19*a* to 19*d* mounted in the carriage 15 through a corresponding one of ink supply tubes 24*a*, 24*b*, 24*c*, 24*d*. When the ink cartridges 22*a* to 22*d* are installed in the cartridge holder 21, the ink cartridges 22*a* to 22*d* are connected to the corresponding valve units 19*a* to 19*d* through the associated ink supply tubes 24*a* to 24*d*.

The first ink cartridge 22*a* receives photo black ink, or first liquid, and the second ink cartridge 22*b* receives matte black ink, or second liquid. Thus, the first valve unit 19*a* temporarily retains the photo black ink and the second valve unit 19*b* temporarily retains the matte black ink.

The photo black ink is suitable for printing on glossy paper and the matte black ink is suitable for printing on matte paper. As shown in FIG. 2, a switching device 25 is arranged between the valve units 19*a*, 19*b* of the carriage 15 and the recording head 18. The switching device 25 switches the ink supplied from the valve units 19*a*, 19*b* to the recording head 18 between the photo black ink and the matte black ink.

The switching device 25 switches the ink ejected from the nozzle row 20*a* of the recording head 18 between the photo black ink and the matte black ink depending on whether glossy paper or matte paper is used. The switching device 25 includes a switching unit 25A, which switches the inks, and a drive unit 25B, which drives the switching unit 25A.

With reference to FIG. 1, a home position of the carriage 15 is defined at a position close to the right end in the body frame 12. A maintenance unit 26, which performs cleaning on the recording head 18, is provided at the home position. The maintenance unit 26 includes a cap 27, which air-tightly seals the nozzle rows 20*a* to 20*c* of the recording head 18 and receives the ink that has been ejected from the nozzle rows 20*a* to 20*c* through flushing.

The switching unit 25A will hereafter be explained in detail.

Figure 3:
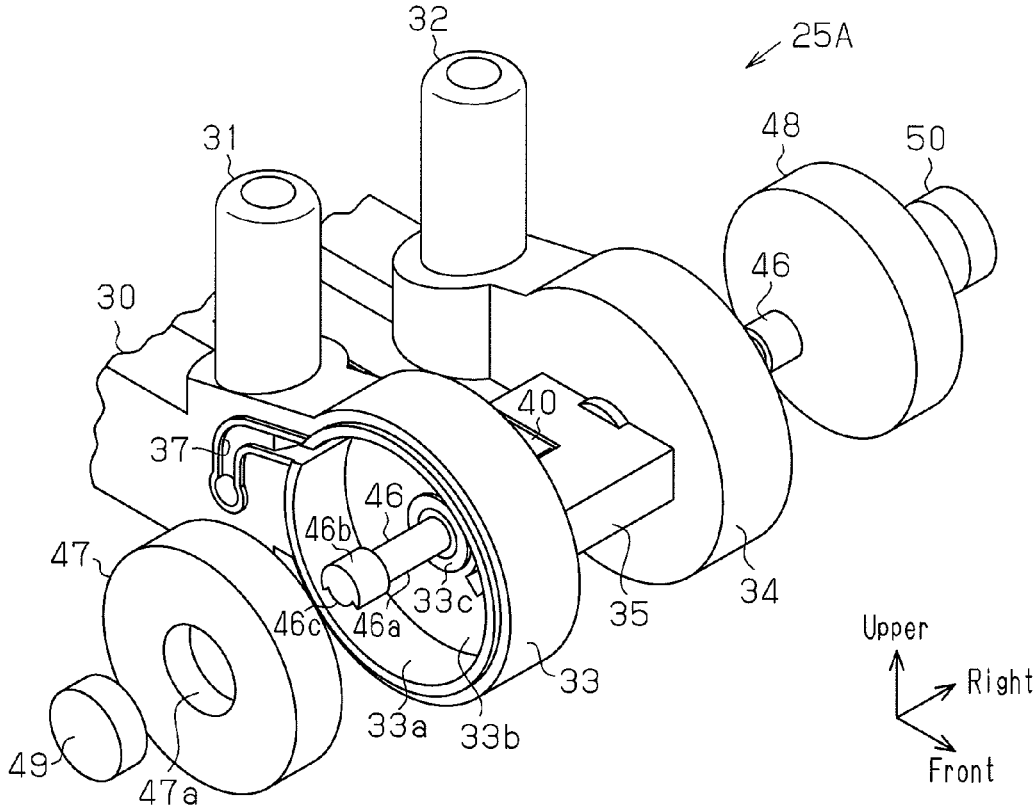
FIG. 3 is an exploded perspective view showing a switching unit of the printer shown in FIG. 1.
Figure 4:
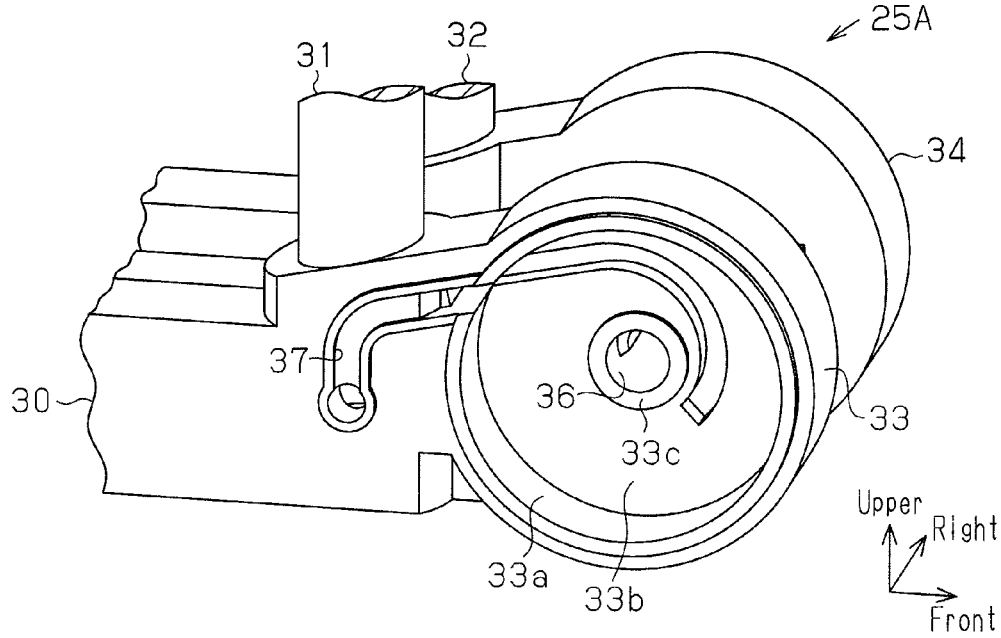
FIG. 4 is a perspective view showing a main portion of the switching unit shown in FIG. 3.
Figure 5:
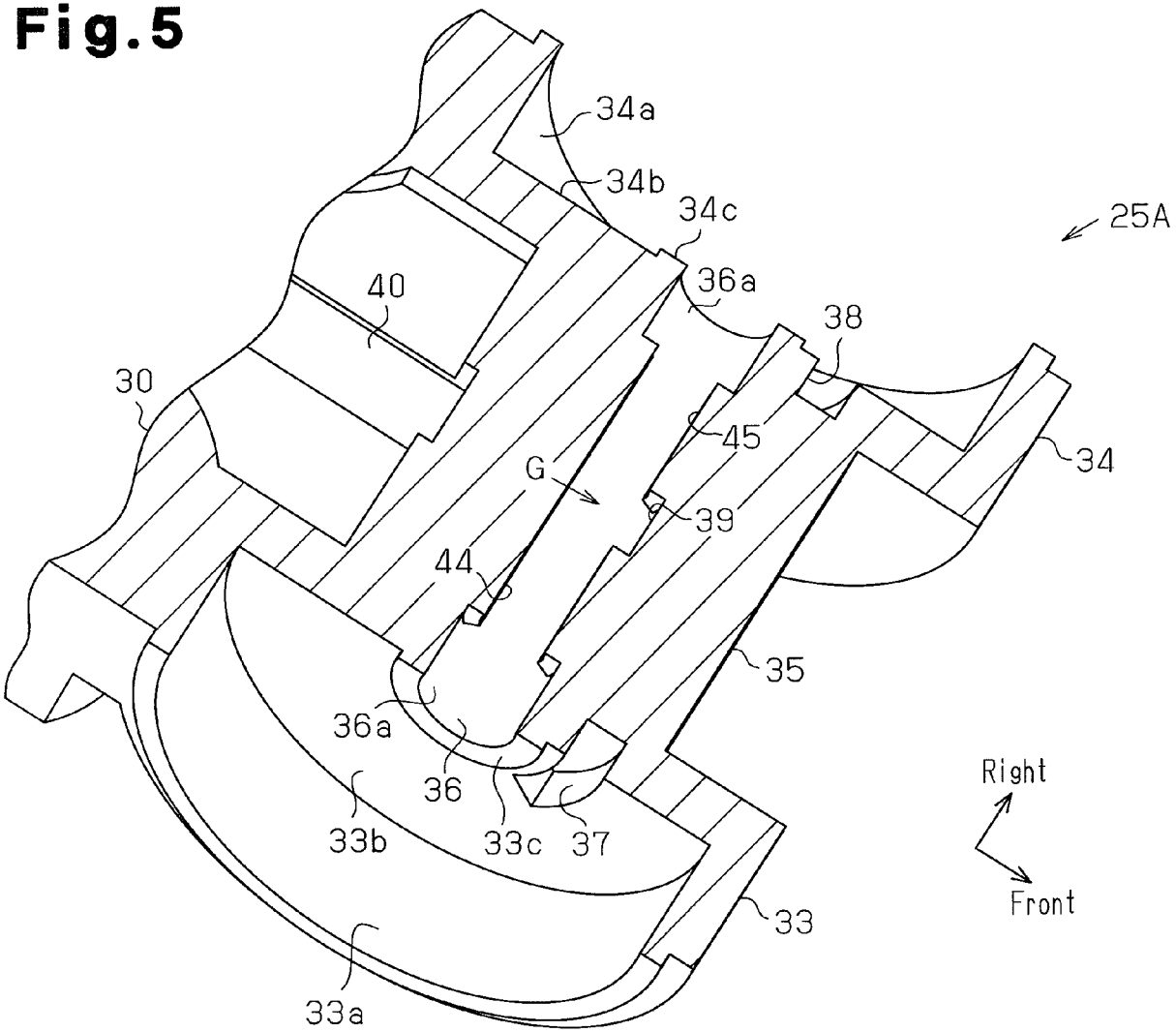
FIG. 5 is an enlarged cross-sectional view showing a main portion of the switching unit shown in FIG. 3.

As shown in FIGS. 3 to 5, the switching unit 25A includes a body 30 having a symmetric block-like shape and a pair of connection pipes, or a first connection pipe 31 and a second connection pipe 32. The first and second connection pipes 31, 32 are provided on the upper surface of the body 30 and spaced from each other at a predetermined interval. The first connection pipe 31 is connected to the first valve unit 19*a* and the second connection pipe 32 is connected to the second valve unit 19*b*. The switching unit 25A has a first valve body receiving portion 33 having a cylindrical shape and a bottom with an opening faced leftward and a second valve body receiving portion 34 having a cylindrical shape and a bottom with an opening faced rightward. The first valve body receiving portion 33 is arranged forward from the first connection pipe 31 and the second valve body receiving portion 34 is provided forward from the second connection pipe 32.

A joint portion 35 is formed between the first valve body receiving portion 33 and the second valve body receiving portion 34. A joint passage 36, which extends linearly along the left-and-right direction, is defined in the joint portion 35. The first and second valve body receiving portions 33, 34 communicate with each other at their centers through the joint passage 36. In other words, the joint passage 36 has openings at the centers of the first and second valve body receiving portions 33, 34.

A first communication groove 37, through which the first connection pipe 31 communicates with the interior of the first valve body receiving portion 33, is defined in the body 30. The first communication groove 37 has a proximal end connected to the first connection pipe 31. The first communication groove 37 extends from its proximal end sequentially on the left surface of the body 30, an inner circumferential surface 33*a* of the first valve body receiving portion 33, and an inner bottom surface 33*b* of the first valve body receiving portion 33, in this order. The first communication groove 37 extends around the opening of the joint passage 36 on the inner bottom surface 33*b* from above and reaches a position diagonally downward and forward from the opening of the joint passage 36. An annular first projection 33*c* projects from the inner bottom surface 33*b* of the first valve body receiving portion 33 and encompasses the opening of the joint passage 36.

Like the first communication groove 37, a second communication groove 38, through which the second connection pipe 32 communicates with the interior of the second valve body receiving portion 34, is defined in the body 30. The second communication groove 38 has a proximal end connected to the second connection pipe 32. The second communication groove 38 extends from its proximal end sequentially on the right surface of the body 30, an inner circumferential surface 34*a* of the second valve body receiving portion 34, and an inner bottom surface 34*b* of the second valve body receiving portion 34, in this order. The second communication groove 38 extends around the opening of the joint passage 36 on the inner bottom surface 34*b* from above and reaches a position diagonally downward and forward from the opening of the joint passage 36. An annular second projection 34*c* projects from the inner bottom surface 34*b* of the second valve body receiving portion 34 and encompasses the opening of the joint passage 36.

Figure 6:
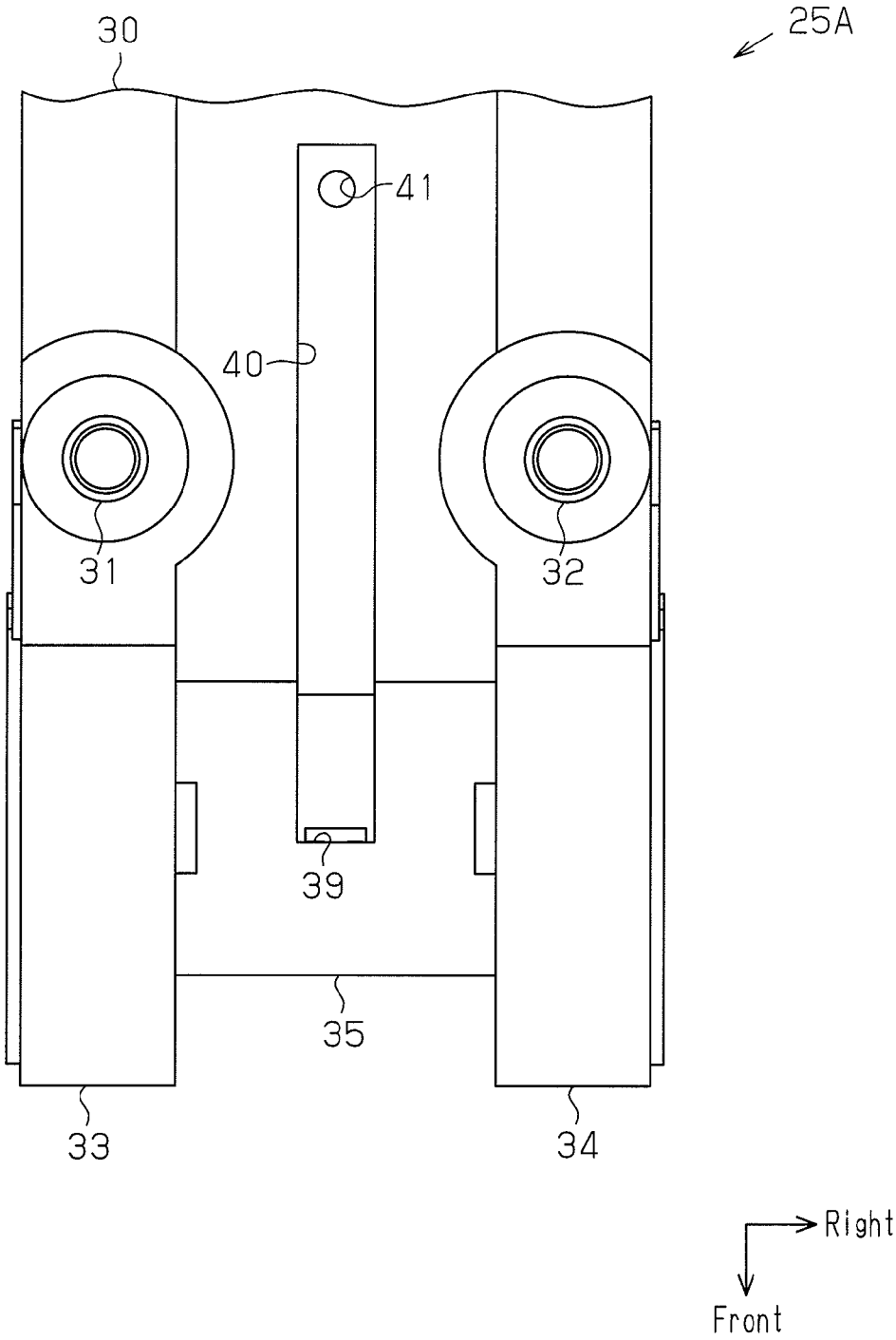
FIG. 6 is a plan view showing the switching unit shown in FIG. 3.

As illustrated in FIG. 6, a groove 40 extending in the front-and-rear direction is defined in the upper surface of the joint portion 35. With reference to FIGS. 5 and 6, a first through hole 39 connecting the joint passage 36 to the front end of the groove 40, is defined at a forward position at the center of the joint passage 36 in the left-and-right direction. A second through hole 41 communicating with the recording head 18 (see FIG. 2) is defined at the rear end of the groove 40. A non-illustrated seal member, which seals the opening of the groove 40, is arranged on the upper surface of the joint portion 35. In the first embodiment, the first through hole 39, the groove 40, and the second through hole 41 form a head supply passage.

As illustrated in FIG. 5, a first joint line 44 is defined by the portion of the joint passage 36 extending leftward from the center in the left-and-right direction. A second joint line 45 is defined by the portion of the joint passage 36 extending rightward from the center. The center of the joint passage 36 forms a joining point G between the first joint line 44 and the second joint line 45. The first joint line 44, the second joint line 45, and the first through hole 39 communicate with one another at the joining point G.

In the first embodiment, the first communication groove 37 (see FIG. 4), the interior of the first valve body receiving portion 33, and the first joint line 44 define a first supply passage. The second communication groove 38, the interior of the second valve body receiving portion 34, and the second joint line 45 define a second supply passage. A large diameter portion 36*a*, the diameter of which is greater than the diameter of the center of the joint passage 36, is formed at each of the two ends of the joint passage 36, which are the left end of the first joint line 44 and the right end of the second joint line 45.

Figure 7:
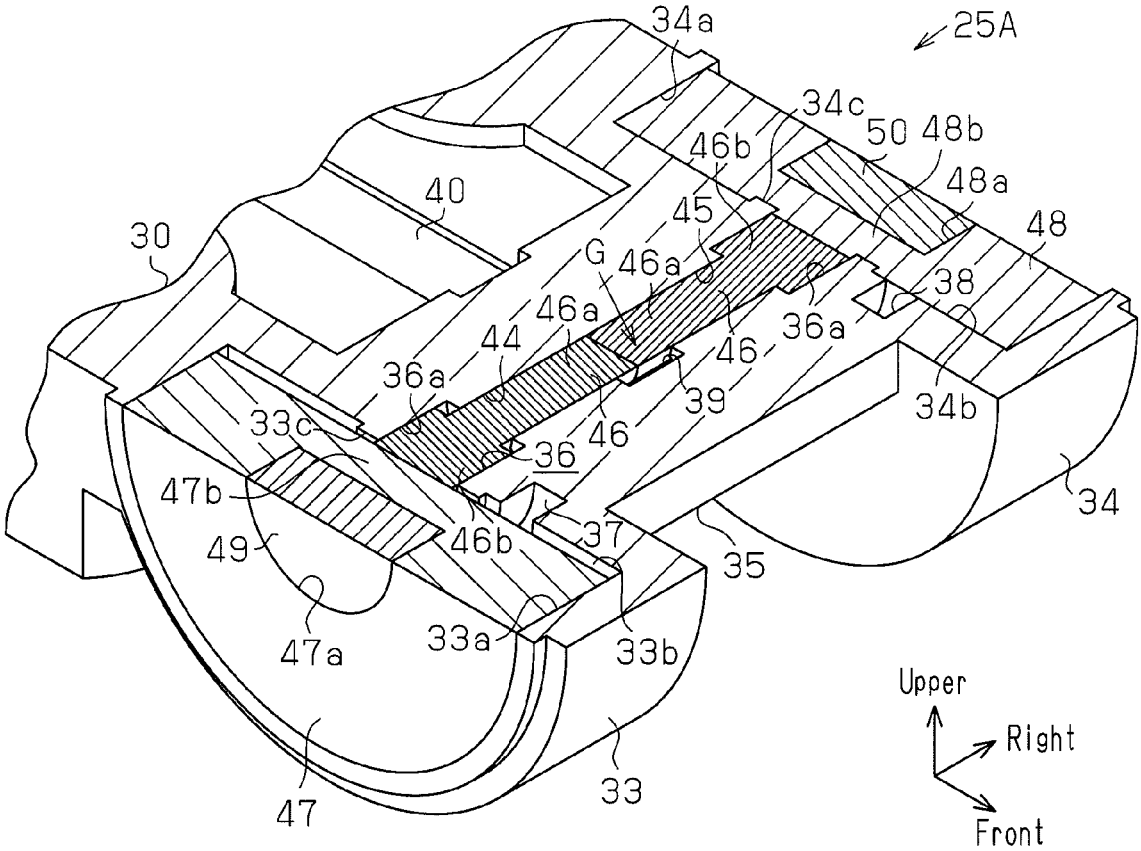
FIG. 7 is a cross-sectional view showing a main portion of the switching unit shown in FIG. 3.
Figure 8:
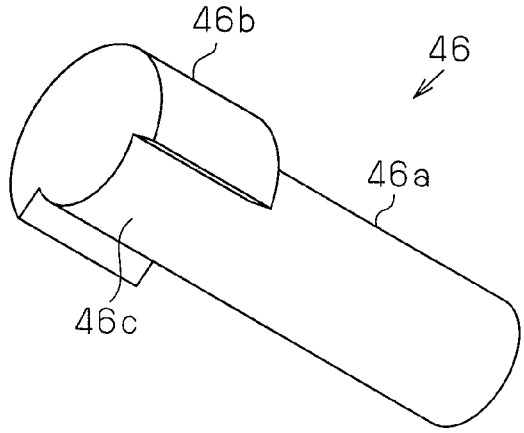
FIG. 8 is a perspective view showing a transmission member of the switching unit shown in FIG. 3.

As shown in FIG. 7, substantially columnar transmission members 46 are received in the first joint line 44 and the second joint line 45 in such a manner that the transmission members 46 are slidable in the left-and-right direction. With reference to FIG. 8, each of the transmission members 46 has a columnar small diameter portion 46*a* and a large diameter portion 46*b* the diameter of which is greater than the diameter of the small diameter portion 46*a*. A cutout 46*c* is provided in the large diameter portion 46*b* in such a manner as to cover the angular range of 90 degrees. The diameter of the cutout 46*c* is equal to the diameter of the small diameter portion 46*a*.

With reference to FIGS. 3 and 7, one of the two transmission members 46 is passed through the first joint line 44 from the side corresponding to the small diameter portion 46*a* and the other transmission member 46 is passed through the second joint line 45 from the side corresponding to the small diameter portion 46*a*. In this manner, each of the transmission members 46 is accommodated in the corresponding one of the joint lines 44, 45. In this case, the cutout 46*c* of each transmission member 46 faces downward and the large diameter portion 46*b* of the transmission member 46 is received in the corresponding large diameter portion 36*a* of the joint passage 36. The end surfaces of the small diameter portions 46*a* of the transmission members 46 contact each other at the center of the joint passage 36 in the left-and-right direction. The sum of the longitudinal dimensions of the two transmission members 46 is slightly greater than the longitudinal dimension of the joint passage 36 in the left-and-right direction.

A first disk-like flexible ON-OFF valve 47 is loosely arranged in the first valve body receiving portion 33 and a second ON-OFF valve 48 shaped and configured identically with the first ON-OFF valve 47 are loosely received in the second valve body receiving portion 34. A first circular recess 47*a* is defined in the outer central portion of the first ON-OFF valve 47 and a second circular recess 48*a* is provided in the outer central portion of the second ON-OFF valve 48. A first disk-like rigid link member 49 is loosely received in the first recess 47*a* and a second disk-like rigid link member 50 is loosely accommodated in the second recess 48*a*.

Figure 10:
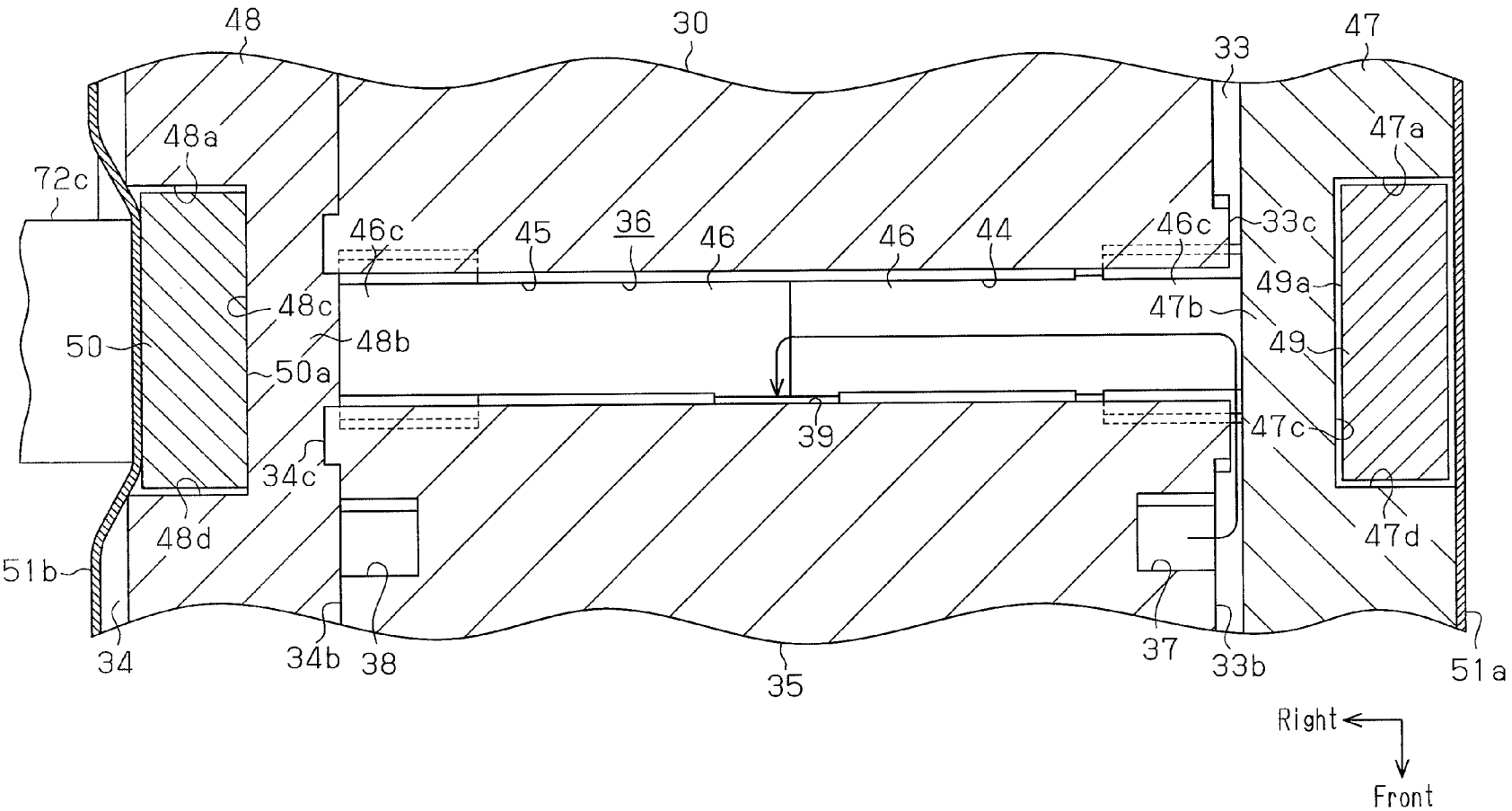
FIG. 10 is an enlarged cross-sectional view showing a main portion of the switching unit shown in FIG. 3 with a first ON-OFF valve open and a second ON-OFF valve closed.

The first recess 47*a* and the second recess 48*a* are shaped identically with each other and the first link member 49 and the second link member 50 are shaped identically with each other. As shown in FIG. 10, a first flexible film 51*a* is secured to the left surface of the body 30 in such a manner as to seal the opening of the first valve body receiving portion 33 and the opening of the first communication groove 37. A second flexible film 51*b* is secured to the right surface of the body 30 in such a manner as to seal the opening of the second valve body receiving portion 34 and the opening of the second communication groove 38.

With reference to FIGS. 7 and 10, a portion of the first ON-OFF valve 47 corresponding to the first recess 47*a* forms a first film-like portion 47*b*. The inner bottom surface 47*c* of the first recess 47*a* extends parallel with a right surface 49*a* of the first link member 49. The inner circumferential surface (the inner side surface) of the first recess 47*a* extends perpendicular to the inner bottom surface 47*c*. The inner circumferential surface of the first recess 47*a* forms a first guide surface 47*d*.

A portion of the second ON-OFF valve 48 corresponding to the second recess 48*a* forms a second film-like portion 48*b*. The inner bottom surface 48*c* of the second recess 48*a* extends parallel with a left surface 50*a* of the second link member 50. The inner circumferential surface (the inner side surface) of the second recess 48*a* extends perpendicular to the inner bottom surface 48*c*. The inner circumferential surface of the second recess 48*a* forms a second guide surface 48*d*.

The drive unit 25B is configured as will be explained in detail in the following.

Figure 9:
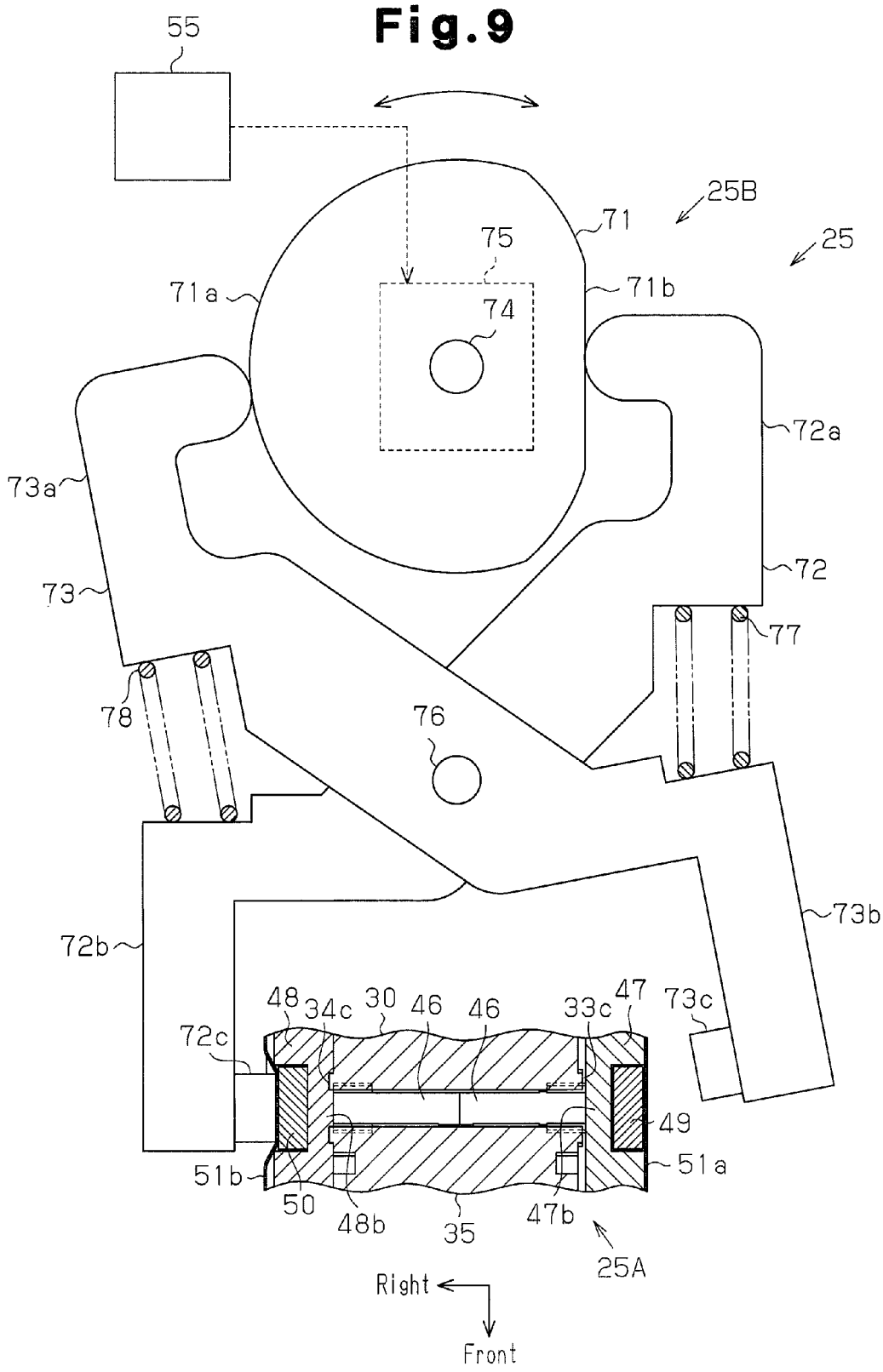
FIG. 9 is a view representing operation of the switching unit shown in FIG. 3.

As shown in FIG. 9, the drive unit 25B includes a rotary plate cam 71 formed by a plate with a non-circularly curved outer circumference, a first actuating plate 73 serving as a first actuator, and a second actuating plate 72 serving as a second actuator. A shaft 74 extends from the center of the plate cam 71 in a direction perpendicular to the plate cam 71. A cam motor 75 is connected to the distal end of the shaft 74. The plate cam 71 is driven by the cam motor 75 to pivot in a forward direction or a reverse direction about the shaft 74. A control section 55 is electrically connected to the cam motor 75 to control operation of the cam motor 75.

A first cam surface 71*a* and a second cam surface 71*b* are formed in the outer circumference of the plate cam 71. As the plate cam 71 pivots, the first actuating plate 73 and the second actuating plate 72 become sequentially engaged with the first cam surface 71*a* and the second cam surface 71*b*. The first cam surface 71*a* is an arcuate surface the radius of which is the distance from the shaft 74, which is the pivotal center of the plate cam 71. The distance from the shaft 74 to the second cam surface 71*b* is smaller than the distance from the shaft 74 to the first cam surface 71*a*.

The first actuating plate 73 and the second actuating plate 72 are shaped identically with each other and are substantially Z-shaped. The first and second actuating plates 73, 72 are overlapped mutually to cross each other at the centers of the actuating plates 73, 72 with one of the actuating plates 73, 72 held in a reversed state. The first and second actuating plates 73, 72 are supported by a single shaft 76 extending perpendicularly to the first and second actuating plates 73, 72 in such a manner that the first and second actuating plates 73, 72 are allowed to swing. The first and second actuating plates 73, 72 are thus allowed to swing in a forward direction or a reverse direction about the shaft 76.

The first actuating plate 73 (the second actuating plate 72) has a first follower portion 73*a* (a second follower portion 72*a*) and a first pressing and actuating portion 73*b* (a second pressing and actuating portion 72*b*). The first follower portion 73*a* (the second follower portion 72*a*) is arranged close to one end of the first actuating plate 73 (the second actuating plate 72) with respect to the shaft 76. The first pressing and actuating portion 73*b* (the second pressing and actuating portion 72*b*) is located close to another end with respect to the shaft 76. The plate cam 71 is arranged between the first follower portion 73*a* and the second follower portion 72*a*. The distal end of the first follower portion 73*a* and the distal end of the second follower portion 72*a* are each bent toward the plate cam 71 and slidably contact the outer circumference of the plate cam 71, or the first cam surface 71*a* and the second cam surface 71*b*.

A first coil spring 77, or a suppressing member, is provided between the second follower portion 72*a* and the first pressing and actuating portion 73*b*. The first coil spring 77 constantly urges the second follower portion 72*a* and the first pressing and actuating portion 73*b* to separate from each other. Similarly, a second coil spring 78, or a suppressing member, is provided between the first follower portion 73*a* and the second pressing and actuating portion 72*b*. The second coil spring 78 constantly urges the first follower portion 73*a* and the second pressing and actuating portion 72*b* to separate from each other. Thus, the distal end of the first follower portion 73*a* and the distal end of the second follower portion 72*a* are constantly pressed against the outer circumference of the plate cam 71 by the urging force of the second coil spring 78 and the urging force of the first coil spring 77, respectively.

A first projected portion 73*c* and a second projected portion 72*c*, which project inwardly in a mutually opposing manner, are formed in the distal end of the first pressing and actuating portion 73*b* and the distal end of the second pressing and actuating portion 72*b*, respectively. The switching unit 25A is located between the first pressing and actuating portion 73*b* and the second pressing and actuating portion 72*b*, or the first projected portion 73*c* and the second projected portion 72*c*. Specifically, the switching unit 25A is arranged in such a manner that the right surface of the second link member 50 opposes the distal surface of the second projected portion 72*c* and the left surface of the first link member 49 opposes the distal surface of the first projected portion 73*c*.

As the plate cam 71 pivots, the first actuating plate 73 and the second actuating plate 72 each swing about the shaft 76. This causes the second projected portion 72*c* to press the second link member 50 from the right to the left through the second film 51*b* or the first projected portion 73*c* to press the first link member 49 from the left to the right through the first film 51*a*. In FIG. 9, the second projected portion 72*c* presses the second link member 50 from the right to the left through the second film 51*b*.

Operation of the switching device 25 will hereafter be explained.

Figure 11:
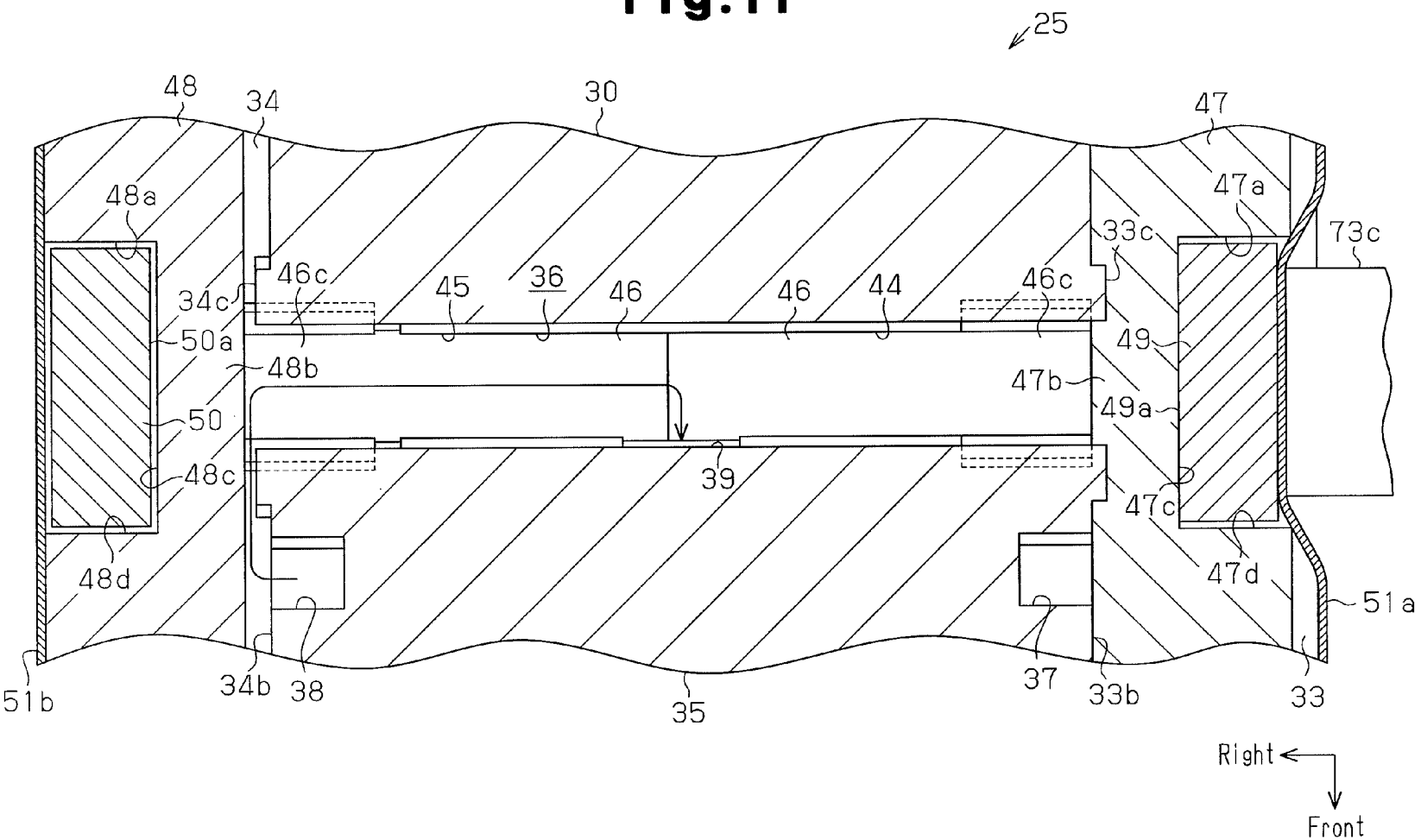
FIG. 11 is an enlarged cross-sectional view showing a main portion of the switching unit shown in FIG. 3 with the first ON-OFF valve closed and the second ON-OFF valve open.

FIGS. 10 and 11 are cross-sectional views each showing the body 30 with the joint portion 35 viewed from below.

To switch the ink supplied to the recording head 18 from the matte black ink to the photo black ink, the plate cam 71 is first pivoted in such a manner as to cause engagement between the first follower portion 73*a* of the first actuating plate 73 and the first cam surface 71*a* of the plate cam 71 and engagement between the second follower portion 72*a* of the second actuating plate 72 and the second cam surface 71*b* of the plate cam 71, as illustrated in FIG. 9.

This causes the second projected portion 72*c* of the second actuating plate 72 to press the second link member 50 from the right to the left through the second film 51*b* and stops the first projected portion 73*c* of the first actuating plate 73 at a position spaced from the first link member 49, or a position at which the first ON-OFF valve 47 is allowed to open. Since the second actuating plate 72 swings about the shaft 76, the second projected portion 72*c* presses the second link member 50 along a path that is not linear but arcuate. This applies the pressing force of the second projected portion 72*c* to the right surface of the second link member 50 in a direction slightly inclined with respect to the leftward direction. However, the second link member 50 linearly moves in the leftward direction while guided by the second guide surface 48*d*.

This causes contact between the left surface 50*a* of the second link member 50 and the inner bottom surface 48*c* of the second recess 48*a*, causing the second link member 50 to move the second film-like portion 48*b* leftward. Thus, the second film-like portion 48*b* tightly contacts the second projection 34*c* and the two transmission members 46 are pressed leftward. The transmission members 46 thus press the first ON-OFF valve 47 leftward, separating the first ON-OFF valve 47 from the first projection 33*c*.

This permits communication between the first communication groove 37 and the first joint line 44 through the interior of the first valve body receiving portion 33 and prohibits communication between the second communication groove 38 and the second joint line 45. In other words, as illustrated in FIG. 10, the first ON-OFF valve 47 becomes open while the second ON-OFF valve 48 becomes closed. At this stage, the pressing force produced by the second projected portion 72*c* acts as valve closing force that closes the second ON-OFF valve 48. The valve closing force is transmitted to the first ON-OFF valve 47 through the two transmission members 46 as valve opening force that opens the first ON-OFF valve 47. Thus, closure of the second ON-OFF valve 48 and opening of the first ON-OFF valve 47 are brought about simultaneously.

Then, the matte black ink, which has been used previously, is ejected from the nozzle row 20*a* of the recording head 18 into the cap 27 through flushing. This causes the photo black ink to flow from the first communication groove 37 to the first joint line 44 through the interior of the first valve body receiving portion 33. In such flushing, the ink is ejected exclusively from the nozzle row 20*a*. As indicated by the arrow in FIG. 10, the photo black ink, which has flown into the first joint line 44, reaches the first through hole 39. In this manner, the ink supplied to the recording head 18 is switched from the matte black ink to the photo black ink.

When the second ON-OFF valve 48 is maintained in a closed state, the pressing force of the second projected portion 72*c* continuously acts on the second ON-OFF valve 48 as the valve closing force. If this state is maintained for a long time, the second actuating plate 72 may deteriorate and deform as the time elapses. This lowers tight contact performance of the second film-like portion 48*b* with respect to the second projection 34*c*. However, in the first embodiment, the first actuating plate 73 is held in a stopped state with the first ON-OFF valve 47 and the first projection 33*c* spaced from each other, as long as the second ON-OFF valve 48 is maintained in the closed state. This causes the first follower portion 73*a* to maintain the second coil spring 78 in a contracted state.

Such contraction of the second coil spring 78 correspondingly increases the force (the valve closing force) produced by the second projected portion 72*c* to press the second ON-OFF valve 48 in a closing direction. That is, the urging force of the second coil spring 78 applied to the second pressing and actuating portion 72*b* is increased. This suppresses lowering of the tight contact performance between the second film-like portion 48*b* and the second projection 34*c* when the second ON-OFF valve 48 is held in the closed state.

To switch the ink supplied to the recording head 18 from the photo black ink to the matte black ink, the plate cam 71 is pivoted in such a manner that the second follower portion 72*a* of the second actuating plate 72 becomes engaged with the first cam surface 71*a* of the plate cam 71, and the first follower portion 73*a* of the first actuating plate 73 becomes engaged with the second cam surface 71*b* of the plate cam 71.

This causes the first projected portion 73*c* of the first actuating plate 73 to press the first link member 49 from the left to the right through the first film 51*a* and stops the second projected portion 72*c* of the second actuating plate 72 at a position spaced from the second link member 50, or a position at which the second ON-OFF valve 48 is allowed to open. Since the first actuating plate 73 swings about the shaft 76, the first projected portion 73*c* presses the first link member 49 along a path that is not linear but arcuate. This applies the pressing force of the first projected portion 73*c* to the left surface of the first link member 49 in a direction slightly inclined with respect to the rightward direction. However, the first link member 49 linearly moves in the rightward direction while guided by the first guide surface 47*d*.

This causes contact between the right surface 49*a*of the first link member 49 and the inner bottom surface 47*c* of the first recess 47*a*. The first link member 49 thus deforms the first film-like portion 47*b* rightward. Such deformation of the first film-like portion 47*b* brings about firm contact between the first film-like portion 47*b* and the first projection 33*c* and presses the two transmission members 46 rightward. The transmission members 46 thus press the second ON-OFF valve 48 rightward, separating the second ON-OFF valve 48 from the second projection 34*c*.

This permits communication between the second communication groove 38 and the second joint line 45 through the interior of the second valve body receiving portion 34 and prohibits communication between the first communication groove 37 and the first joint line 44. In other words, with reference to FIG. 11, the second ON-OFF valve 48 becomes open and the first ON-OFF valve 47 becomes closed. In this state, the pressing force generated by the first projected portion 73*c* acts as the valve closing force that closes the first ON-OFF valve 47. Such valve closing force is transmitted to the second ON-OFF valve 48 through the transmission members 46. Thus, closure of the first ON-OFF valve 47 and opening of the second ON-OFF valve 48 are brought about simultaneously.

Subsequently, the photo black ink, which has been previously used, is ejected from the nozzle row 20*a* of the recording head 18 into the cap 27 through flushing. This causes the matte black ink to flow from the second communication groove 38 into the second joint line 45 through the interior of the second valve body receiving portion 34. In flushing, the ink is ejected exclusively from the nozzle row 20*a*. Then, as indicated by the arrow in FIG. 11, the matte black ink flows from the second joint line 45 to the first through hole 39. In this manner, the ink supplied to the recording head 18 is switched from the photo black ink to the matte black ink.

When the first ON-OFF valve 47 is held in a closed state, the pressing force of the first projected portion 73*c* acts on the first ON-OFF valve 47 as the valve closing force. If such state is maintained for a long time, the first actuating plate 73 becomes deformed as the time elapses, which lowers the tight contact performance of the first film-like portion 47*b* with respect to the first projection 33*c*. However, in the first embodiment, the second actuating plate 72 is maintained in a stopped state with the first ON-OFF valve 47 and the second projection 34*c* spaced from each other, as long as the first ON-OFF valve 47 is held in a closed state. Thus, the second follower portion 72*a* maintains the first coil spring 77 in a contracted state.

This correspondingly increases the force (the valve closing force) generated by the first projected portion 73*c* to press the first ON-OFF valve 47 in the closing direction. In other words, the urging force produced by the first coil spring 77 to urge the first pressing and actuating portion 73*b* is increased. This suppresses lowering of the tight contact performance between the first film-like portion 47*b* and the first projection 33*c* when the first ON-OFF valve 47 is maintained in a closed state.

To switch between the photo black ink and the matte black ink, the second actuating plate 72 is swung to cause the second projected portion 72*c* to press the second film-like portion 48*b* in the valve closing direction or the first actuating plate 73 is swung to cause the first projected portion 73*c* to press the first film-like portion 47*b* in the valve closing direction.

Such swinging of the first actuating plate 73 and the second actuating plate 72, which cross each other, is caused by pivot of the single rotary plate cam 71. This decreases the space needed for operation of the cam compared to a case in which a translation cam is used. Accordingly, the drive unit 25B (the switching device 25) is reduced in size.

The first embodiment has the following advantages.

Typically, a rotary cam requires small space for operation compared to a translation cam. In the first embodiment, since the first actuating plate 73 and the second actuating plate 72, which selectively open and close the first ON-OFF valve 47 and the second ON-OFF valve 48, respectively, are driven through rotation of the rotary plate cam 71, the size of the space necessary for operation is decreased. Accordingly, the switching device 25, which switches the types of the ink supplied to the recording head 18, is reduced in size. As a result, the inkjet type printer 11 becomes small in size.

The first actuating plate 73 and the second actuating plate 72 are both operated through rotation of the single rotary plate cam 71. This decreases the number of components compared to a case in which the first actuating plate 73 and the second actuating plate 72 are separately actuated by independent cams.

The two transmission members 46 transmit the force with which the first projected portion 73*c* of the first actuating plate 73 presses and closes the first ON-OFF valve 47 to the second ON-OFF valve 48 as the force that opens the second ON-OFF valve 48. The transmission members 46 also transmit the force with which the second projected portion 72*c* of the second actuating plate 72 operates to close the second ON-OFF valve 48 to the first ON-OFF valve 47 as the force that opens the first ON-OFF valve 47. Thus, closure of the first ON-OFF valve 47 and opening of the second ON-OFF valve 48 or closure, of the second ON-OFF valve 48 and the opening of the first ON-OFF valve 47 are brought about simultaneously. This allows quick switching of the types of the ink supplied to the recording head 18 between the photo black ink and the matte black ink.

The single shaft 76 swingably supports the first actuating plate 73 and the second actuating plate 72. This reduces the number of components, compared to a case in which the first actuating plate 73 and the second actuating plate 72 are supported separately by independent shafts in such a manner that the first and second actuating plates 73, 72 swing.

By operating the plate cam 71 to rotate in a single direction, the first actuating plate 73 and the second actuating plate 72 are each swung. In this manner, the first ON-OFF valve 47 and the second ON-OFF valve 48 are switched sequentially and alternately between the state in which one of the first ON-OFF valve 47 and the second ON-OFF valve 48 is closed and the other one is open and the state in which one of the first ON-OFF valve 47 and the second ON-OFF valve 48 is open and the other one is closed.

When the second ON-OFF valve 48 is maintained in a closed state, the first follower portion 73*a* contracts the second coil spring 78. This correspondingly increases the force with which the second coil spring 78 restores its original shape, increasing the force with which the second coil spring 78 urges the second pressing and actuating portion 72*b*. Accordingly, the force with which the second projected portion 72*c* urges the second ON-OFF valve 48 in the valve closing direction is increased. Thus, lowering of the tight contact performance of the second film-like portion 48*b* with respect to the second projection 34*c* is suppressed when the second ON-OFF valve 48 is maintained in the closed state.

When the first ON-OFF valve 47 is held in a closed state, the second follower portion 72*a* contracts the first coil spring 77. This correspondingly increases the force with which the first coil spring 77 restores its original shape, increasing the force with which the first coil spring 77 urges the first pressing and actuating portion 73*b*. Accordingly, the force with which the first projected portion 73*c* urges the first ON-OFF valve 47 in the valve closing direction is increased. Thus, lowering of the tight contact performance of the first film-like portion 47*b* with respect to the first projection 33*c* is suppressed when the first ON-OFF valve 47 is maintained in the closed state.

This enhances reliability when the first ON-OFF valve 47 or the second ON-OFF valve 48 is held in closed states.

Switching between the matte black ink and the photo black ink is carried out through flushing in which the ink is ejected exclusively from the nozzle row 20*a*. Thus, in such switching of the inks, the inks other than the matte black ink and the photo black ink are prevented from being consumed. However, if the cap 27 is an integral type that covers all of the nozzle rows 20*a* to 20*c* collectively and the matte black ink and the photo black ink are switched between each other through cleaning, the inks other than the matte black ink and the photo black ink are wastefully consumed.

A second embodiment of the present invention will hereafter be explained with reference to the attached drawings, focusing on the differences between the second embodiment and the first embodiment.

Figure 12:
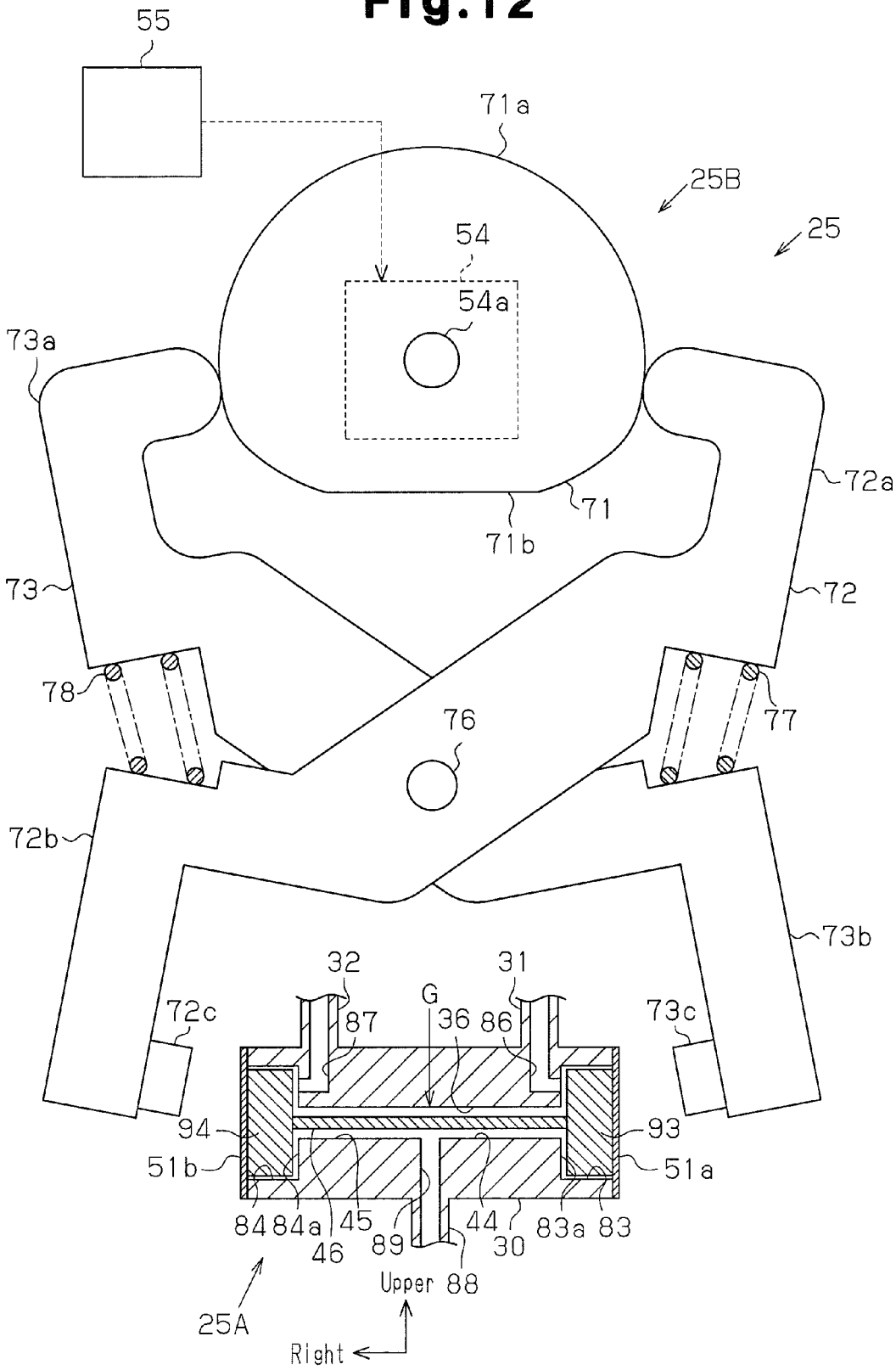
FIG. 12 is a view showing a switching unit according to a second embodiment of the present invention with a first ON-OFF valve and a second ON-OFF valve both open.

FIG. 12 shows a switching unit 25A according to the second embodiment.

As shown in FIG. 12, the switching unit 25A of the second embodiment has a first circular accommodating recess 83 and a second circular accommodating recess 84. The first accommodating recess 83 has an opening that is defined in the left surface of a body 30 of the switching unit 25A and faces leftward. The second accommodating recess 84 has an opening that is defined in the right surface of the body 30 and faces rightward. A joint passage 36, which extends in the body 30 along the left-and-right direction, allows communication between the first accommodating recess 83 and the second accommodating recess 84. The joint passage 36 has openings at the center of a bottom surface 83*a* of the first accommodating recess 83 and the center of a bottom surface 84*a* of the second accommodating recess 84.

Further, a first passage 86 allowing communication between the interior of a first connection pipe 31 and the interior of the first accommodating recess 83, and a second passage 87 allowing communication between the interior of a second connection pipe 32 and the interior of the second accommodating recess 84 are defined in the body 30. In other words, the first passage 86 has an opening defined at a position upward from the opening of the joint passage 36 in the bottom surface 83*a* of the first accommodating recess 83. The second passage 87 has an opening defined at a position upward from the opening of the joint passage 36 in the bottom surface 84*a* of the second accommodating recess 84.

A third connection pipe 88 projects downward from the center of the lower surface of the body 30 in the left-and-right direction. The third connection pipe 88 is connected to the recording head 18. A third passage 89, which allows communication between the interior of the joint passage 36 and the interior of the third connection pipe 88, is defined below the center of the joint passage 36 of the body 30 in the left-and-right direction. In the second embodiment, the interior of the third connection pipe 88 and the third passage 89 form a head supply passage.

With reference to FIG. 12, the third passage 89 is connected to the center of the joint passage 36, or a joining point G between a first joint line 44 and a second joint line 45. In the second embodiment, the interior of the first connection pipe 31, the first passage 86, the interior of the first accommodating recess 83, and the first joint line 44 form a first supply passage. The interior of the second connection pipe 32, the second passage 87, the interior of the second accommodating recess 84, and the second joint line 45 form a second supply passage. In the second embodiment, the inner diameter of the joint passage 36 is uniform along the longitudinal direction of the joint passage 36.

In the second embodiment, a single transmission member 46 extends in the joint passage 36. The transmission member 46 has a round bar-like shape and is formed in such a manner that the outer diameter of the transmission member 46 becomes smaller than the inner diameter of the joint passage 36. The transmission member 46 is movable in the joint passage 36 along the left-and-right direction. The longitudinal dimension of the transmission member 46 is slightly greater than the longitudinal dimension of the joint passage 36. The left end and the right end of the transmission member 46 are capable of projecting into the first accommodating recess 83 and the second accommodating recess 84, respectively.

A first disk-like flexible ON-OFF valve 93 and a second ON-OFF valve 94 configured identically with the first ON-OFF valve 93 are loosely accommodated in the first accommodating recess 83 and the second accommodating recess 84, respectively. In the second embodiment, a first film 51*a* is secured to the left surface of the body 30 in such a manner as to tightly seal the opening of the first accommodating recess 83. Further, a second film 51*b* is secured to the right surface of the body 30 in such a manner as to tightly seal the opening of the second accommodating recess 84.

The left surface of the first ON-OFF valve 93 contacts the right surface of the first film 51*a* in a surface contact manner and the left end surface of the transmission member 46 contacts the center of the right surface of the first ON-OFF valve 93. A gap may be defined between the right surface of the first ON-OFF valve 93 and the bottom surface 83*a* of the first accommodating recess 83. The right surface of the second ON-OFF valve 94 contacts the left surface of the second film 51*b* in a surface contact manner and the right end surface of the transmission member 46 contacts the center of the left surface of the second ON-OFF valve 94. A gap may be defined between the left surface of the second ON-OFF valve 94 and the bottom surface 84*a* of the second accommodating recess 84.

A drive unit 25B of the second embodiment is configured identically with the drive unit 25B of the first embodiment.

FIG. 12 illustrates a state in which the first ON-OFF valve 93 and the second ON-OFF valve 94 are both open, or a state in which the gaps are defined both between the right surface of the first ON-OFF valve 93 and the bottom surface 83*a* of the first accommodating recess 83 and between the left surface of the second ON-OFF valve 94 and the bottom surface 84*a* of the second accommodating recess 84.

Operation of a switching device 25 of the second embodiment will hereafter be explained.

Figure 13:
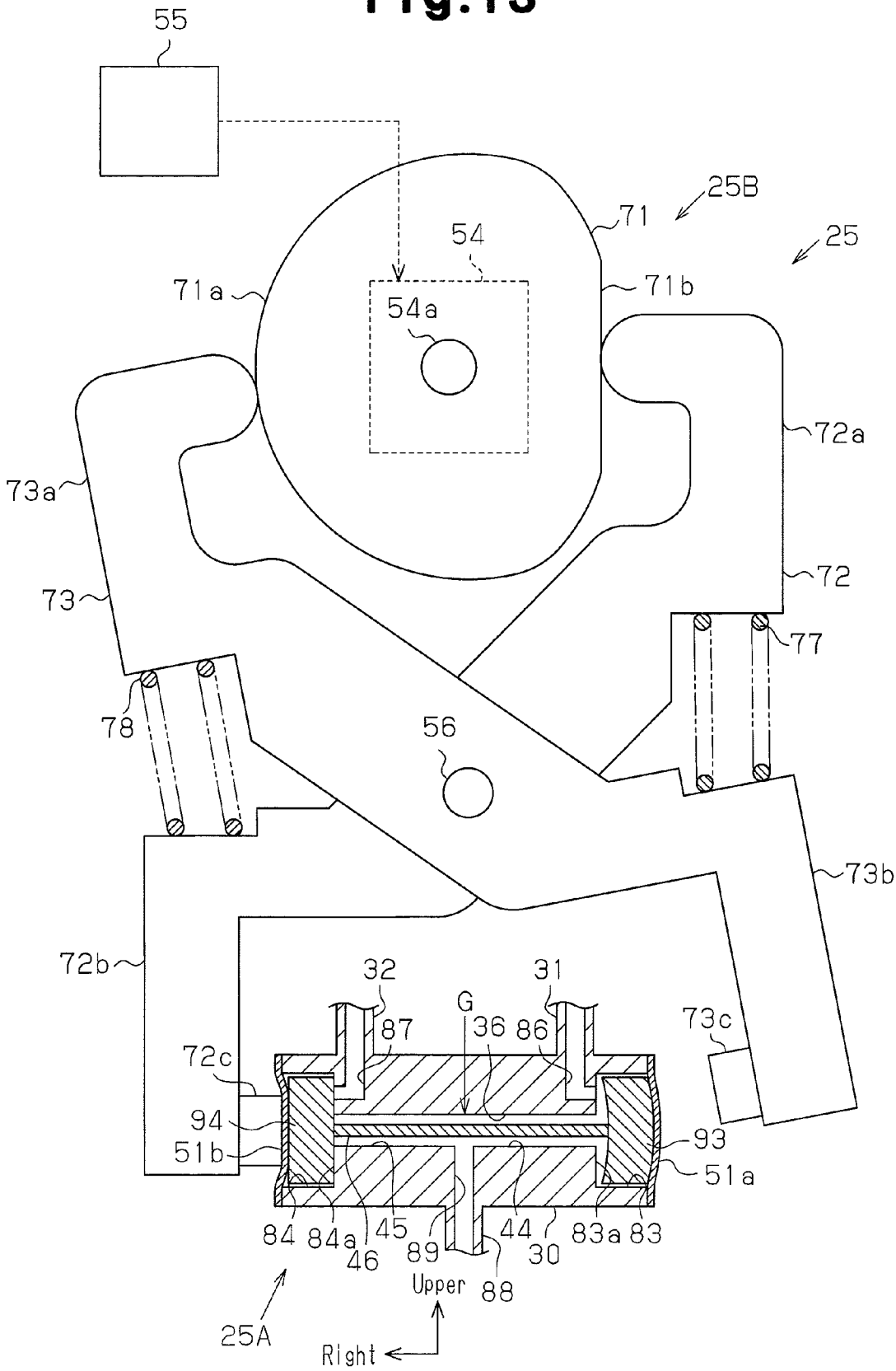
FIG. 13 is a view showing the switching unit according to the second embodiment with the first ON-OFF valve open and the second ON-OFF valve closed.

To switch the ink supplied to the recording head 18 from the matte black ink to the photo black ink, a plate cam 71 is first pivoted in such a manner that a first follower portion 73*a* of a first actuating plate 73 becomes engaged with a first cam surface 71*a* of the plate cam 71 and a second follower portion 72*a* of a second actuating plate 72 becomes engaged with a second cam surface 71*b* of the plate cam 71, as illustrated in FIG. 13.

This causes a second projected portion 72*c* of the second actuating plate 72 to press the second ON-OFF valve 94 from the right to the left through the second film 51*b* and stops a first projected portion 73*c* of the first actuating plate 73 at a position spaced from the first film 51*a*. This moves the second ON-OFF valve 94 leftward, causing the second ON-OFF valve 94 to tightly contact the bottom surface 84*a* of the second accommodating recess 84 and press the transmission member 46 leftward. In this state, the bottom surface 84*a* of the second accommodating recess 84 functions as a valve seat of the second ON-OFF valve 94.

Since the first ON-OFF valve 93 is pressed leftward by the transmission member 46, the first ON-OFF valve 93 is moved leftward while flexibly deforming in such a manner that the right surface of the first ON-OFF valve 93 becomes depressed. The first ON-OFF valve 93 thus separates from the bottom surface 83*a* of the first accommodating recess 83 and presses the first film 51*a* leftward. As a result, the first film 51*a* flexibly deforms in a manner bulging leftward.

This opens the first ON-OFF valve 93 and closes the second ON-OFF valve 94. In this state, the pressing force produced by the second projected portion 72*c* acts as valve closing force that closes the second ON-OFF valve 94. The valve closing force is transmitted to the first ON-OFF valve 93 through the transmission member 46 as valve opening force that opens the first ON-OFF valve 93. Thus, closure of the second ON-OFF valve 94 and opening of the first ON-OFF valve 93 are brought about simultaneously.

Subsequently, the matte black ink, which has been previously used, is ejected from a nozzle row 20*a* of the recording head 18 into a cap 27 through flushing. This causes the photo black ink to flow from the first passage 86 into the first joint line 44 through the interior of the first accommodating recess 83. In such flushing, the ink is ejected exclusively from the nozzle row 20*a*. The photo black ink then flows from the first joint line 44 into the third connection pipe 88 through the third passage 89. In this manner, the ink supplied to the recording head 18 is switched from the matte black ink to the photo black ink.

Figure 14:
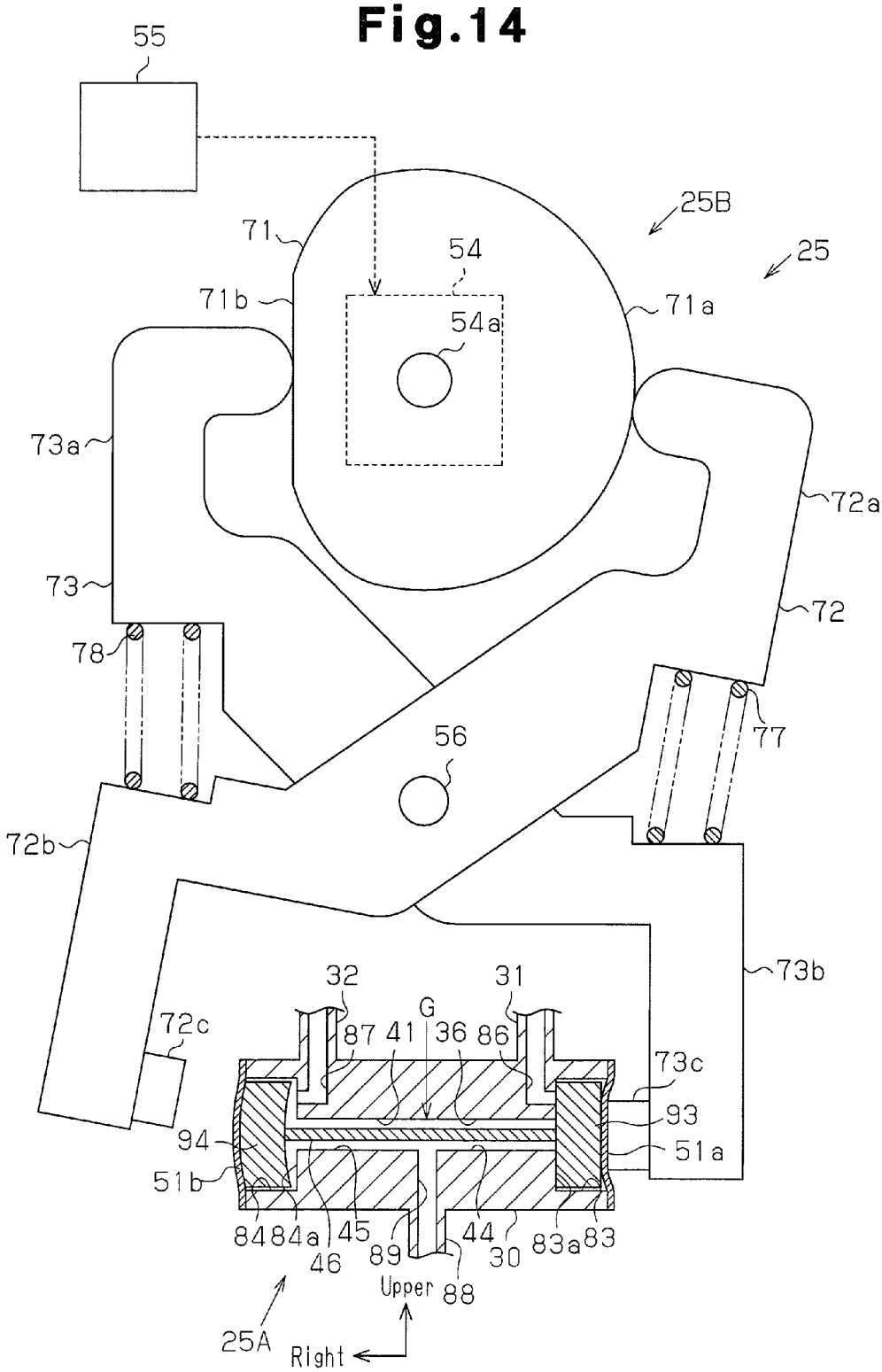
FIG. 14 is a view showing the switching unit according to the second embodiment with the first ON-OFF valve closed and the second ON-OFF valve open.

To switch the ink supplied to the recording head 18 from the photo black ink to the matte black ink, the plate cam 71 is pivoted in such a manner that the first follower portion 73*a* of the first actuating plate 73 becomes engaged with the second cam surface 71*b* of the plate cam 71 and the second follower portion 72*a* of the second actuating plate 72 becomes engaged with the first cam surface 71*a* of the plate cam 71, as illustrated in FIG. 14.

This causes the first projected portion 73*c* of the first actuating plate 73 to press the first ON-OFF valve 93 from the left to the right through the first film 51*a* and separates the second projected portion 72*c* of the second actuating plate 72 from the second film 51*b*. The second ON-OFF valve 94 is thus moved rightward, causing the first ON-OFF valve 93 to tightly contact the bottom surface 83*a* of the first accommodating recess 83 and press the transmission member 46 rightward. In this state, the bottom surface 83*a* of the first accommodating recess 83 functions as a valve seat of the first ON-OFF valve 93.

The second ON-OFF valve 94 is thus pressed rightward by the transmission member 46 and moved rightward while flexibly deforming in such a manner that the left surface of the second ON-OFF valve 94 becomes depressed. This separates the second ON-OFF valve 94 from the bottom surface 84*a* of the second accommodating recess 84, and the second ON-OFF valve 94 presses the second film 51*b* rightward. In this manner, the second film 51*b* flexibly deforms in a manner bulging rightward.

This opens the second ON-OFF valve 94 and closes the first ON-OFF valve 93. In this state, the pressing force produced by the first projected portion 73*c* acts as valve closing force that closes the first ON-OFF valve 93. The valve closing force is transmitted to the second ON-OFF valve 94 through the transmission member 46. Thus, closure of the first ON-OFF valve 93 and opening of the second ON-OFF valve 94 are brought about simultaneously.

Next, the photo black ink, or the ink that has been used previously, is ejected from the nozzle row 20*a* of the recording head 18 into the cap 27 through flushing. This causes the matte black ink to flow from the second passage 87 into the second joint line 45 through the interior of the second accommodating recess 84. In such flushing, the ink is ejected exclusively from the openings of the nozzle row 20*a*. Then, the matte black ink flows from the second joint line 45 into the third connection pipe 88 through the third passage 89. In this manner, the ink supplied to the recording head 18 is switched from the photo black ink to the matte black ink.

To switch between the photo black ink and the matte black ink, the first actuating plate 73 is swung in such a manner that the first projected portion 73*c* presses the first ON-OFF valve 93 in a closing direction or the second actuating plate 72 is swung in such a manner that the second projected portion 72*c* presses the second ON-OFF valve 94, as has been described.

Swinging of the first actuating plate 72 and the second actuating plate 73 is brought about through rotation of the common rotary plate cam 71. This decreases the size of the space needed for operation of the cam, compared to a case in which the plate cam 71 is changed to a translation cam that linearly slides. Accordingly, the drive unit 25B (the switching device 25) becomes small in size.

The printer 11 according to the second embodiment operates as will be described, when initial filling of the photo black ink and initial filling of the matte black ink are carried out simultaneously.

To perform initial filling of the photo black ink and initial filling of the matte black ink simultaneously, the switching device 25 must be held in the state in which the first ON-OFF valve 93 and the second ON-OFF valve 94 are both open, as illustrated in FIG. 12.

Thus, in accordance with the following method, the switching device 25 is switched from the state in FIG. 13, in which the first ON-OFF valve 93 is open and the second ON-OFF valve 94 is closed, or the state in which the photo black ink is selected, to the state in FIG. 12, in which the first and second ON-OFF valves 93, 94 are both open.

When the first ON-OFF valve 93 is open and the second ON-OFF valve 94 is closed as illustrated in FIG. 13, the first follower portion 73*a* of the first actuating plate 73 is engaged with the first cam surface 71*a* of the plate cam 71, and the second follower portion 72*a* of the second actuating plate 72 is engaged with the second cam surface 71*b* of the plate cam 71.

In this state, the plate cam 71 is pivoted by 180 degrees counterclockwise as viewed from front. This causes engagement between the first follower portion 73*a* of the first actuating plate 73 and the second cam surface 71*b* of the plate cam 71, and engagement between the second follower portion 72*a* of the second actuating plate 72 and the first cam surface 71*a* of the plate cam 71, as illustrated in FIG. 14. In other words, the first ON-OFF valve 93 is closed and the second ON-OFF valve 94 is opened.

Subsequently, in this state, the plate cam 71 is pivoted by 90 degrees counterclockwise as viewed from front. This engages the first follower portion 73*a* of the first actuating plate 73 and the second follower portion 72*a* of the second actuating plate 72 both with the first cam surface 71*a* of the plate cam 71, with reference to FIG. 12. In this state, the first actuating plate 73 and the second actuating plate 72 swing in such a manner as to separate the first projected portion 73*c* and the second projected portion 72*c* from the first film 51*a* and the second film 51*b*, respectively.

Accordingly, with reference to FIG. 14, the second film 51*b*, which has been flexibly deformed in a state bulging rightward, restores its original shape using its elastic shape restoring force. The second film 51*b* thus presses the second ON-OFF valve 94 slightly leftward. This also moves the transmission member 46 and the first ON-OFF valve 93 slightly leftward, switching the switching device 25 to the state in which the first ON-OFF valve 93 and the second ON-OFF valve 94 are both open.

If the state illustrated in FIG. 14, in which the first ON-OFF valve 93 is closed and the second ON-OFF valve 94 is open, is maintained for a long time, the right surface of the first ON-OFF valve 93 becomes adhered to the bottom surface 83*a* of the first accommodating recess 83. Thus, the first ON-OFF valve 93 cannot be opened simply by pivoting the plate cam 71 from this state by 90 degrees counterclockwise as viewed from front to separate the first projected portion 73*c* from the first film 51*a*.

However, in the second embodiment, the second ON-OFF valve 94 is switched from the open state to the closed state to separate the first ON-OFF valve 93 from the bottom surface 83*a* of the first accommodating recess 83. The first projected portion 72*c* and the second projected portion 73*c* are then separated from the first film 51*a* and the second film 51*b*, respectively. The switching device 25 is thus reliably switched to the state (illustrated in FIG. 12) in which the first ON-OFF valve 93 and the second ON-OFF valve 94 are both open.

Afterwards, the interior of the cap 27 is subjected to suction by a suction pump with the recording head 18 held in contact with the cap 27 in such a manner that the nozzle rows 20*a* to 20*c* of the recording head 18 are covered by the cap 27. This accomplishes initial filling of the photo black ink and the matte black ink, simultaneously, in corresponding passages extending from the ink cartridge 22*a* and the ink cartridge 22*b*, respectively, to the switching unit 25A.

Subsequently, a method for switching the switching device 25 from the state illustrated in FIG. 14 to the state illustrated in FIG. 12 will be explained. Specifically, in the state of FIG. 14, the first ON-OFF valve 93 is closed and the second ON-OFF valve 94 is open, or the matte black ink is selected. In the state of FIG. 12, the first ON-OFF valve 93 and the second ON-OFF valve 94 are both open.

With reference to FIG. 14, when the first ON-OFF valve 93 is closed and the second ON-OFF valve 94 is open, the first follower portion 73*a* of the first actuating plate 73 is engaged with the second cam surface 71*b* of the plate cam 71, and the second follower portion 72*a* of the second actuating plate 72 is engaged with the first cam surface 71*a* of the plate cam 71.

In this state, the plate cam 71 is pivoted by 80 degrees clockwise as viewed from front. Then, as illustrated in FIG. 13, the first follower portion 73*a* of the first actuating plate 73 becomes engaged with the first cam surface 71*a* of the plate cam 71 and the second follower portion 72*a* of the second actuating plate 72 becomes engaged with the second cam surface 71*b* of the plate cam 71. In other words, the first ON-OFF valve 93 becomes open and the second ON-OFF valve 94 becomes closed.

Subsequently, the plate cam 71 is pivoted from this state by 90 degrees counterclockwise as viewed from front. In this manner, with reference to FIG. 12, the first follower portion 73*a* of the first actuating plate 73 and the second follower portion 72*a* of the second actuating plate 72 both become engaged with the first cam surface 71*a* of the plate cam 71. In this state, the first actuating plate 73 and the second actuating plate 72 swing in such a manner as to separate the first projected portion 73*c* and the second projected portion 72*c* from the first film 51*a* and the second film 51*b*, respectively.

This causes the first film 51*a*, which has been flexibly deformed in a manner bulging leftward, to restore its original shape using its elastic shape restoring force. The first film 51*a* thus presses and moves the first ON-OFF valve 93 slightly rightward. This also moves the transmission member 46 and the second ON-OFF valve 94 slightly rightward, switching the switching device 25 to the state in which the first ON-OFF valve 93 and the second ON-OFF valve 94 are both open.

If the state illustrated in FIG. 14, in which the first ON-OFF valve 93 is closed and the second ON-OFF valve 94 is open, is maintained for a long time, the right surface of the first ON-OFF valve 93 becomes adhered to the bottom surface 83*a* of the first accommodating recess 83. Thus, the first ON-OFF valve 93 cannot be opened simply by pivoting the plate cam 71 from this state by 90 degrees clockwise as viewed from front to separate the first projected portion 73*c* from the first film 51*a*.

However, in the second embodiment, the second ON-OFF valve 94 is switched from the open state to the closed state to separate the first ON-OFF valve 93 from the bottom surface 83*a* of the first accommodating recess 83. The first projected portion 72*c* and the second projected portion 73*c* are then separated from the first film 51*a* and the second film 51*b*, respectively. The switching device 25 is thus reliably switched to the state in which the first ON-OFF valve 93 and the second ON-OFF valve 94 are both open, as illustrated in FIG. 12.

Then, suction is performed on the interior of the cap 27 using a suction pump while the recording head 18 is maintained in contact with the cap 27 in such a manner that the nozzle rows 20*a* to 20*c* of the recording head 18 are covered by the cap 27. In this manner, initial filling of the photo black ink and initial filling of the matte black ink in corresponding passages extending from the ink cartridge 22*a* and the ink cartridge 22*b*, respectively, to the switching unit 25A, are achieved simultaneously.

As has been described, the switching device 25 according to the second embodiment has the following advantage in addition to the advantages of the first embodiment.

If one of the first ON-OFF valve 93 and the second ON-OFF valve 94 is maintained in an open state with the other held in a closed state for a long time, the closed one of the ON-OFF valves (the first ON-OFF valve 93 or the second ON-OFF valve 94) adheres to the bottom surface 83*a* of the first accommodating recess 83 or the bottom surface 84*a* of the second accommodating recess 84, which functions as the valve seat. This makes it impossible to open the closed ON-OFF valve 93, 94, even though the first and second ON-OFF valves 93, 94 are both operated to open. However, in the second embodiment, to switch from the state in which one of the ON-OFF valves 93, 94 is open with the other closed to the state in which the ON-OFF valves 93, 94 are both open, the open one of the ON-OFF valves 93, 94 is closed so that the closed one of the ON-OFF valves 93, 94 is opened through the transmission member 46. Then, the ON-OFF valves 93, 94 are both allowed to open. Thus, even if the closed one of the ON-OFF valves 93, 94 becomes adhered to the valve seat after having been held in the closed state with the other one of the ON-OFF valves 93, 94 maintained open for a long time, the closed one of the ON-OFF valves 93, 94 is reliably opened.

The illustrated embodiments may be modified as follows.

Plate springs or torsion springs may be employed as suppressing members, instead of the first coil spring 77 and the second coil spring 78. Alternatively, the first and second coil springs 77, 78 may be replaced by two sets of repelling magnets. In this case, the repelling forces generated by the two sets of magnets constantly urge the second follower portion 72*a* and the first pressing and actuating portion 73*b* to separate from each other, and the first follower portion 73*a* and the second pressing and actuating portion 72*b* to separate from each other.

The first actuating plate 73 and the second actuating plate 72 may be swingably supported by separate shafts.

The shape of the rotary cam is not restricted to that of the plate cam 71 of each of the illustrated embodiments. That is, the rotary cam may be formed in any suitable shape as long as the cam includes a cam surface that causes swinging of an actuator in a valve opening direction and a cam surface that causes swinging of the actuator in a valve closing direction when the actuator becomes engaged with the cam surfaces.

The two transmission members 46 may be provided as an integral body.

The first actuating plate 73 and the second actuating plate 72 may be driven by separate rotary plate cams 71.

The switching device 25 switches between the matte black ink and the photo black ink. However, such switching may be carried out between a dark tone and a light tone of the same color of ink such as cyan ink and light cyan ink or magenta ink and light magenta ink.

The switching device 25 may be configured in such a manner that the first joint line 44 and the second joint line 45 are connected together to form a V shape or a U shape. In other words, the switching device 25 may be provided in such a manner that the joint passage 36 is V-shaped or a U-shaped. In this case, the shape of each transmission member 46 must be changed in correspondence with the shape of the joint passage 36.

In the illustrated embodiments, the liquid ejection apparatus is embodied by the inkjet type printer 11. However, the liquid ejection apparatus may be a type that ejects other types of liquid than ink (including a liquefied body prepared by dispersing or mixing particles of functional material in liquid, and fluid such as gel). That is, the liquid ejection apparatus may be embodied by, for example, a liquid ejection apparatus that ejects liquid such as electrode material or color material used in the manufacture of EL displays and surface light emitting displays, or a liquid ejection apparatus that ejects bioorganic matter used in the manufacture of biochips or a sample ejection apparatus such as a precision pipette. The "liquid" herein includes, for example, inorganic solvent, organic solvent, solution, liquid resin, and liquid metal (molten metal), as well as liquefied bodies and fluid.

The invention claimed is:

1. A liquid ejection apparatus comprising:

a liquid ejection head that ejects liquid; and a switching device that switches a type of liquid supplied to the liquid ejection head between a first liquid and a second liquid different from the first liquid, the switching device including:

a first supply passage through which the first liquid flows;

a second supply passage through which the second liquid flows;

a head supply passage extending to the liquid ejection head from a joining point between a downstream end of the first supply passage and a downstream end of the second supply passage;

a first ON-OFF valve that selectively opens and closes the first supply passage at a position upstream from the joining point;

a second ON-OFF valve that selectively opens and closes the second supply passage at a position upstream from the joining point;

a rotary cam; and an actuator, wherein, when the cam rotates, the actuator is driven by the cam in such a manner that the first ON-OFF valve and the second ON-OFF valve are selectively opened and closed, the actuator operating the first and second ON-OFF valves in such a manner that one of the first and second ON-OFF valves becomes open and the other becomes closed, wherein the actuator includes a first actuator that closes the first ON-OFF valve and a second actuator that closes the second ON-OFF valve, and wherein the first actuator and the second actuator are driven commonly by the cam.

2. The liquid ejection apparatus according to claim 1, wherein the actuator operates the first and second ON-OFF valves in such a manner that opening of one of the first and second ON-OFF valves occurs synchronously with closure of the other of the first and second ON-OFF valves.

3. The liquid ejection apparatus according to claim 1, wherein the switching device further includes a transmission member arranged between the first ON-OFF valve and the second ON-OFF valve, wherein the transmission member transmits a force applied to the first ON-OFF valve by the first actuator to close the first ON-OFF valve to the second ON-OFF valve as a force that acts to open the second ON-OFF valve, and transmits a force applied to the second ON-OFF valve by the second actuator to close the second ON-OFF valve to the first ON-OFF valve as a force that acts to open the first ON-OFF valve.

4. The liquid ejection apparatus according to claim 1, wherein the first actuator and the second actuator are swingably supported by a common shaft in a state crossing each other.

5. The liquid ejection apparatus according to claim 1, wherein the cam has a first cam surface and a second cam surface with which the first actuator and the second actuator sequentially become engaged when the cam rotates, and wherein each of the actuators is arranged at a position at which the actuator allows opening of the corresponding one of the ON-OFF valves when engaged with the first cam surface, and at a position at which the actuator causes closure of the corresponding ON-OFF valve when engaged with the second cam surface.

6. The liquid ejection apparatus according to claim 1, wherein the switching device further includes a suppressing member that suppresses decrease of a force applied to the corresponding one of the ON-OFF valves by each of the first and second actuators to close the ON-OFF valve.

7. A liquid ejection apparatus comprising:

a liquid ejection head that ejects liquid; and a switching device that switches a type of liquid supplied to the liquid ejection head between a first liquid and a second liquid different from the first liquid, the switching device including:

a first supply passage through which the first liquid flows;

a second supply passage through which the second liquid flows;

a head supply passage extending to the liquid ejection head from a joining point between a downstream end of the first supply passage and a downstream end of the second supply passage;

a first ON-OFF valve that selectively opens and closes the first supply passage at a position upstream from the joining point;

a second ON-OFF valve that selectively opens and closes the second supply passage at a position upstream from the joining point;

an actuator that selectively opens and closes the first ON-OFF valve and the second ON-OFF valve;

a transmission member that transmits a force applied to the first ON-OFF valve by the actuator to close the first ON-OFF valve to the second ON-OFF valve as a force that acts to open the second ON-OFF valve, and transmits a force applied to the second ON-OFF valve by the actuator to close the second ON-OFF valve to the first ON-OFF valve as a force that acts to open the first ON-OFF valve; and a control section that controls the actuator, wherein, to switch from a state in which one of the first and second ON-OFF valves is open and the other is closed to a state in which the first ON-OFF valve and the second ON-OFF valve are both open, the control section closes the open one of the first and second ON-OFF valves to open the closed one of the first and second ON-OFF valves, and then operates to permit the first and second ON-OFF valves to both open.

8. The liquid ejection apparatus according to claim 7, wherein the switching device has a rotary cam controlled by the control section, and wherein the actuator is driven by the cam when the cam rotates.

9. The liquid ejection apparatus according to claim 8, wherein the actuator includes a first actuator that closes the first ON-OFF valve and a second actuator that closes the second ON-OFF valve, and wherein the first actuator and the second actuator are driven commonly by the cam.

10. The liquid ejection apparatus according to claim 9, wherein the cam has a first cam surface and a second cam surface with which the first actuator and the second actuator sequentially become engaged when the cam rotates, and wherein each of the actuators is arranged at a position at which the actuator allows opening of the corresponding one of the ON-OFF valves when engaged with the first cam surface, and a at position at which the actuator causes closure of the corresponding ON-OFF valve when engaged with the second cam surface.

11. The liquid ejection apparatus according to claim 10, wherein the cam is configured to be set in a mode in which the first actuator and the second actuator are both engaged with the first cam surface, and in a mode in which one of the first and second actuators is engaged with the first cam surface and the other of the actuators is engaged with the second cam surface.

12. A method for switching a type of liquid supplied to a liquid ejection head of a liquid ejection apparatus between a first liquid and a second liquid different from the first liquid, the method comprising the steps of:

providing a first supply passage through which the first liquid flows;

providing a second supply passage through which the second liquid flows;

providing a head supply passage extending to the liquid ejection head from a joining point between a downstream end of the first supply passage and a downstream end of the second supply passage;

selectively opening and closing the first supply passage at a position upstream from the joining point using a first ON-OFF valve;

selectively opening and closing the second supply passage at a position upstream from the joining point using a second ON-OFF valve;

transmitting a force applied to the first ON-OFF valve to close the first ON-OFF valve to the second ON-OFF valve as a force that acts to open the second ON-OFF valve;

transmitting a force applied to the second ON-OFF valve to close the second ON-OFF valve to the first ON-OFF valve as a force that acts to open the first ON-OFF valve; and closing, in switching from a state in which one of the first and second ON-OFF valves is open and the other is closed to a state in which the first ON-OFF valve and the second ON-OFF valve are both open, an open one of the first and second ON-OFF valves to open a closed one of the first and second ON-OFF valves and then permitting the first and second ON-OFF valves to both open.

* * * * *